US011326301B2

(12) United States Patent
Yano et al.

(10) Patent No.: US 11,326,301 B2
(45) Date of Patent: May 10, 2022

(54) AUTOMATIC CLOTH SPREADING MACHINE

(71) Applicant: PUREX CO., LTD., Takamatsu (JP)

(72) Inventors: Makoto Yano, Takamatsu (JP); Yuichiro Yabe, Takamatsu (JP)

(73) Assignee: PUREX CO., LTD., Takamatsu (JP)

( * ) Notice: Subject to any disclaimer, the term of this patent is extended or adjusted under 35 U.S.C. 154(b) by 122 days.

(21) Appl. No.: 16/641,768

(22) PCT Filed: Jul. 11, 2018

(86) PCT No.: PCT/JP2018/026146
§ 371 (c)(1),
(2) Date: Feb. 25, 2020

(87) PCT Pub. No.: WO2019/044190
PCT Pub. Date: Mar. 7, 2019

(65) Prior Publication Data

US 2020/0392665 A1 Dec. 17, 2020

(30) Foreign Application Priority Data

Aug. 31, 2017 (JP) ..... JP2017-166918

(51) Int. Cl.
*D06F 67/04* (2006.01)
*D06C 3/00* (2006.01)
*D06F 89/00* (2006.01)

(52) U.S. Cl.
CPC ..... *D06F 67/04* (2013.01); *D06C 3/00* (2013.01); *D06C 2700/10* (2013.01); *D06F 89/00* (2013.01)

(58) Field of Classification Search
CPC ..... D06F 67/00; D06F 67/04; D06F 89/00; D06F 89/02; D06C 3/00; D06C 2700/10; D06C 2700/13
See application file for complete search history.

(56) References Cited

U.S. PATENT DOCUMENTS 3,911,604 A * 10/1975 Sjostrom ..... D06F 67/04 38/143
4,036,365 A * 7/1977 Rosenfeld ..... D06F 95/00 209/3.1

(Continued)

FOREIGN PATENT DOCUMENTS

JP H11-114296 A 4/1999
JP 2002-114403 A 4/2002

(Continued)

OTHER PUBLICATIONS

Aug. 6, 2020 Extended Search Report issued in European Patent Application No. 18851625.6.

(Continued)

*Primary Examiner* — Ismael Izaguirre
(74) *Attorney, Agent, or Firm* — Oliff PLC

(57) ABSTRACT

An automatic cloth spreading machine, that keeps the number of pieces processed even in the event of failure in handling, includes a separating device for separating pieces of cloth one by one from a mass of cloth made of a plurality of pieces of cloth by cloth handling devices, an edge locating device for locating an edge of each of the pieces of cloth having been separated one by one, a spreading device for spreading the piece of cloth, the edge of which has been located, and a discharging device for discharging the piece of cloth having been spread to a subsequent step. The separating device includes multiple units of cloth handling devices that perform the same process, and the multiple units of cloth handling devices simultaneously perform at least one of single- or multiple-step processes of separating pieces of cloth one by one from the mass of cloth.

5 Claims, 29 Drawing Sheets

(56) References Cited

U.S. PATENT DOCUMENTS

| | | | | | |
|---|---|---|---|---|---|
| 4,447,972 | A * | 5/1984 | McCabe | D06F 95/00 | 38/12 |
| 4,943,198 | A * | 7/1990 | McCabe | D06F 95/00 | 198/434 |
| 5,169,282 | A * | 12/1992 | Ueda | D06F 67/04 | 38/7 |
| 6,477,797 | B1 * | 11/2002 | Takahashi | D06F 67/04 | 38/143 |
| 6,826,856 | B1 * | 12/2004 | McCabe | D06F 67/04 | 38/143 |
| 9,587,348 | B2 * | 3/2017 | Yano | B25J 15/0028 | |
| 2008/0092415 | A1 | 4/2008 | McCabe | | |
| 2016/0145055 | A1 * | 5/2016 | Sielermann | B65G 47/90 | 414/751.1 |

FOREIGN PATENT DOCUMENTS

| | | | |
|---|---|---|---|
| JP | 2005-163241 | A | 6/2005 |
| JP | 2010-222724 | A | 10/2010 |

OTHER PUBLICATIONS

Oct. 16, 2018 Search Report issed in International Patent Application No. PCT/JP2018/026146.

* cited by examiner

AUTOMATIC CLOTH SPREADING MACHINE

TECHNICAL FIELD

The present invention relates to an automatic cloth spreading machine that automatically spreads cloth to be processed in a cloth processing factory or the like.

BACKGROUND ART

An automatic cloth spreading machine that is used in a cloth washing factory or the like to spread cloth is equipped with many cloth handling devices that perform operations such as lifting, pulling, and passing cloth. In the automatic cloth spreading machine of Patent Literature 1, for example, the lifting device, the temporary holding device, the corner end locating device, the horizontal pulling device, etc. correspond to such cloth handling devices.

In these types of cloth handling devices, for example, a chuck is configured to hold or release cloth as a pair of clamps thereof is opened or closed by driving means, such as an air cylinder or a motor. The clamps are shaped such that even when pulling cloth, the clamps do not damage the cloth as far as possible.

In these types of cloth handling devices, a corner end of a piece of cloth is located, for example, by a pair of rollers that catches the cloth therebetween and advances the cloth until the corner end is held, and then, with the corner end held therebetween, stops rotating so as to hang the cloth.

CITATION LIST

Patent Literature

Patent Literature 1: Japanese Patent Laid-Open No. 2010-222724

SUMMARY OF INVENTION

Technical Problem

Conventional automatic cloth spreading machines, however, sometimes fail in handling as cloth falls off clamps of a chuck, rollers, etc. in a lifting device, a corner end locating device, and the like. This is a problem because a decrease in the number of pieces processed due to failure in handling results in a decrease in the machine yield of the automatic cloth spreading machine.

In particular, when a cloth sorting device is provided in a step preceding an automatic cloth spreading machine or inside the automatic cloth spreading machine to sort pieces of cloth, and other pieces of cloth than those of a type to be mainly processed are delivered to another transfer path, the number of pieces of cloth of the type to be mainly processed that flow to a subsequent step decreases as the number of pieces of cloth to be sorted increases. Thus, a decrease in the number of pieces processed due to failure in handling inside the automatic cloth spreading machine has a significant impact.

Therefore, an object of the present invention is to advantageously solve the problem with the above conventional art and provide an automatic cloth spreading machine that can keep up the number of pieces processed even in the event of failure in handling.

Solution to Problem

The present invention provides an automatic cloth spreading machine including a separating means for separating pieces of cloth one by one from a mass of cloth consisting of a plurality of pieces of cloth by a cloth handling device, an edge locating means for locating an edge of each of the pieces of cloth having been separated one by one, a spreading means for spreading the piece of cloth, the edge of which has been located, and a discharging means for discharging the piece of cloth having been spread to a subsequent step. The separating means includes multiple units of cloth handling devices that perform the same process, and the multiple units of cloth handling devices simultaneously perform at least one of single- or multiple-step processes of separating pieces of cloth one by one from the mass of cloth.

Advantageous Effects of Invention

In the automatic cloth spreading machine of the present invention, the separating means separates pieces of cloth one by one from a mass of cloth consisting of a plurality of pieces of cloth by the cloth handling devices; the edge locating means locates an edge of each of the pieces of cloth having been separated one by one; the spreading means spreads the piece of cloth, the edge of which has been located; and the discharging means discharges the piece of cloth having been spread to a subsequent step. Here, the separating means includes multiple units of cloth handling devices that perform the same process, and these multiple units of cloth handling devices simultaneously perform at least one of the single- or multiple-step processes of separating pieces of cloth one by one from the mass of cloth.

Thus, in the automatic cloth spreading machine of the present invention, even when one of the multiple units of cloth handling devices that perform the same process as the separating means fails in handling, the other cloth handling devices simultaneously perform the same process so as not to disrupt the process. Therefore, a decrease in the number of pieces processed in a step subsequent to the separating means can be prevented.

In the automatic cloth spreading machine of the present invention, it is preferable that the separating means includes two units of cloth handling devices that perform the same process, and that the two units of cloth handling devices simultaneously perform at least one of the single- or multiple-step processes of separating pieces of cloth one by one from the mass of cloth.

Thus, even when one of the two units of cloth handling devices that perform the same process as the separating means fails in handling, the other cloth handling device simultaneously performs the same process so as not to disrupt the process. Therefore, a decrease in the number of pieces processed in a step subsequent to the separating means can be prevented by a minimum necessary, inexpensive configuration.

In the automatic cloth spreading machine of the present invention, it is preferable that the separating means includes multiple units of cloth handling devices that perform the process of separating pieces of cloth one by one from the mass of cloth sequentially in a plurality of steps, and that some of these units of cloth handling devices be cloth handling devices that perform the same process.

Thus, the separating means includes multiple units of cloth handling devices that perform the process of separating pieces of cloth one by one sequentially in a plurality of steps, and some of these multiple units of cloth handling devices that perform the same process perform one of the plurality of steps simultaneously. Even when one of the multiple units of cloth handling devices that perform the same process in one of the plurality of steps fails in handling, the other cloth handling devices simultaneously perform the same process so as not to disrupt the process. Therefore, a decrease in the number of pieces processed in a step subsequent to the separating means can be reliably prevented.

In the automatic cloth spreading machine of the present invention, it is more preferable that the separating means includes supply conveyors, lifting devices, temporary holding devices, corner end locating devices, and corner end receiving devices as the multiple units of cloth handling devices that perform the process of separating pieces of cloth one by one sequentially in a plurality of steps, and that multiple units each of these supply conveyors, lifting devices, temporary holding devices, corner end locating devices, and corner end receiving devices simultaneously perform the same process.

Thus, the separating means includes the supply conveyors, the lifting devices, the temporary holding devices, the corner end locating devices, and the corner end receiving devices as the multiple units of cloth handling devices that perform the process sequentially in a plurality of steps, and multiple units each of these devices simultaneously perform the same process. Even when one of the multiple units of cloth handling devices fails in handling in one of the plurality of processing steps, the other cloth handling devices simultaneously perform the same process so as not to disrupt the process. Therefore, a decrease in the number of pieces processed in a step subsequent to the separating means can be reliably prevented.

BRIEF DESCRIPTION OF DRAWINGS

FIG. 35 (*b*) is an enlarged side view showing an example of failed handling by the chuck of the lifting device; and FIGS. 35 (*c*) and (*d*) are views specifically illustrating examples of failed handling by the chuck of the lifting device.

DESCRIPTION OF EMBODIMENTS

An embodiment of the present invention will be described in detail below based on the drawings. An automatic cloth spreading machine as one embodiment of the present invention is suitable for automatically supplying cloth, such as towels, to a cloth folding machine, a cloth washing machine, etc. installed in a cloth washing factory or the like. In the following, the present invention will be described by taking, as one example of use, an example in which the automatic cloth spreading machine of the embodiment is applied to feeding cloth into a cloth folding machine.

Figure 1:
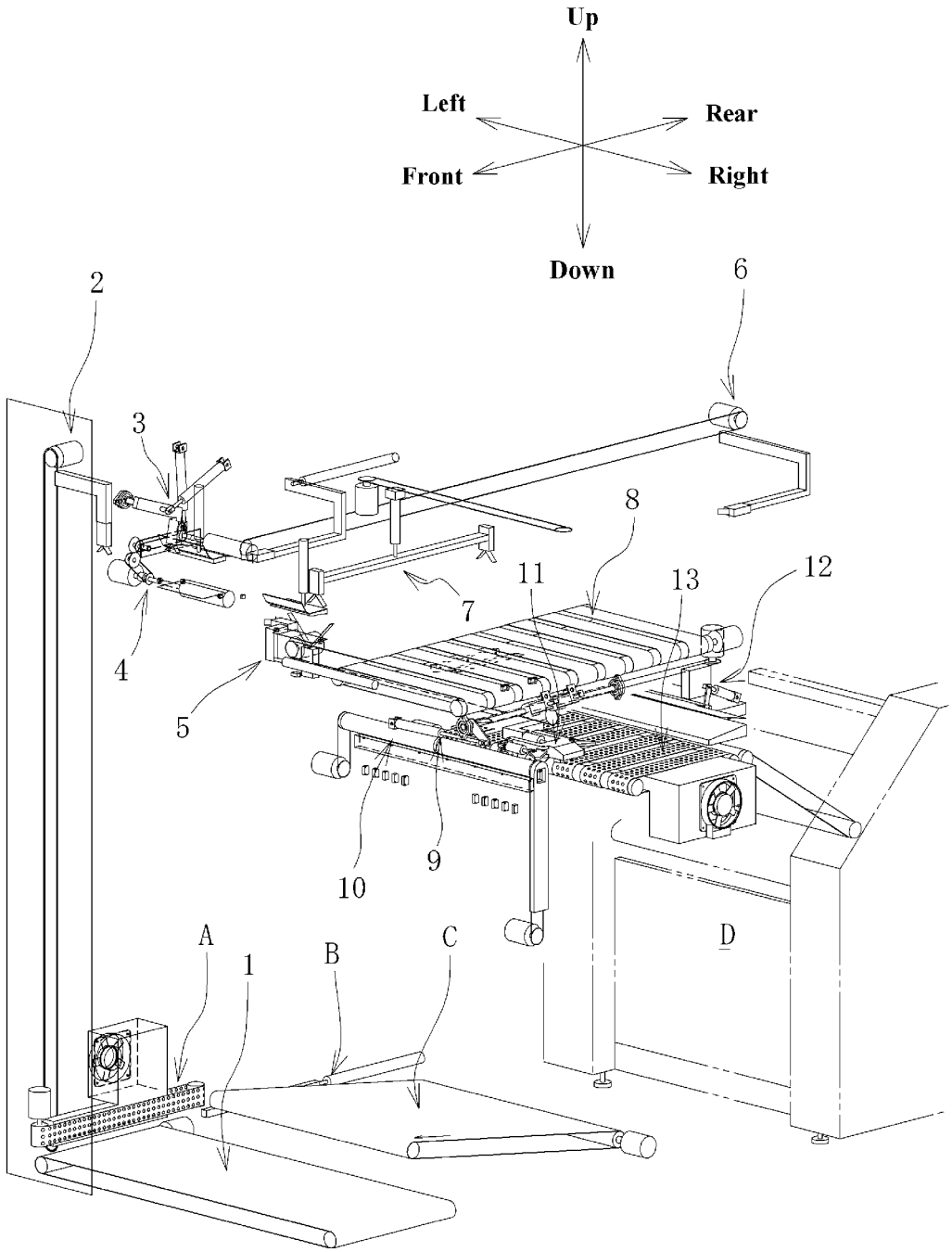
FIG. 1 is a schematic overall view of an automatic cloth spreading machine of a reference embodiment of the present invention.

FIG. 1 shows an overall view of the automatic cloth spreading machine in a reference embodiment of the present invention, and FIG. 2 to FIG. 34 show individual devices that are parts of the automatic cloth spreading machine of FIG. 1. In the following description, the directions of front, rear, right, left, up, and down refer to those directions in the state of FIG. 1.

The automatic cloth spreading machine in this reference embodiment automatically spreads washed and dried pieces of cloth, such as towels, sheets, duvet covers, pillow covers, or Japanese bathrobes. As shown in FIG. 1, the automatic cloth spreading machine mainly includes a supply conveyor 1, a lifting device 2, a temporary holding device 3, a corner end locating device 4, a corner end receiving device 5, a horizontal pulling device 6, a two-position holding device 7, an edge locating conveyor 8, a vertically inverting device 9, a roller 10, a hanging device 11, a forward-backward moving device 12, a transfer conveyor 13, and a controller (not shown) that controls the operations of the devices 1 to 13. In FIG. 1, a suction conveyor A, a push-out device B, a return conveyor C, and a cloth folding machine D are shown as assisting or related devices. The return conveyor C returns cloth that has fallen during processing to the supply conveyor 1.

The automatic cloth spreading machine in this reference embodiment operates roughly as follows: The supply conveyor 1 supplies washed and dried cloth to under the lifting device 2. The lifting device 2 lifts the cloth to a predetermined level. The temporary holding device 3 receives the lifted cloth, temporarily holds the cloth, and moves the cloth to a position at which the cloth is passed to the corner end locating device 4. The corner end locating device 4 receives an arbitrary portion of the cloth hanging from the temporary holding device 3 and reveals a corner end of the cloth. The corner end receiving device 5 holds this corner end, and moves the cloth toward the horizontal pulling device 6 while supporting the cloth in a drooping state. The horizontal pulling device 6 lays the cloth substantially horizontally in a front-rear direction. The two-position holding device 7 holds the laid cloth at two positions, one near a corner end and the other at an intermediate portion away from the corner end by an appropriate distance, at the same level, moves the cloth to above the edge locating conveyor 8, and then releases the intermediate portion of the cloth being held.

The edge locating conveyor 8 receives thereon another portion of the cloth being held at the corner end by the two-position holding device 7, and moves that portion so as to reveal one long-side edge of the cloth. The vertically inverting device 9 holds the long-side edge of the cloth coming down from the edge locating conveyor 8, inverts the cloth upside down, and then holds the cloth in a drooping state. A hanging device 11 that moves above the roller 10 in a left-right direction along the roller 10 receives the long-side edge of the cloth from the vertically inverting device 9 and hangs the drooping cloth on the roller 10. The roller 10 advances the cloth hung thereon such that the cloth droops toward the forward-backward moving device 12 while a short-side edge of the cloth is left on the roller 10. The forward-backward moving device 12 moves forward and receives the short-side edge of the cloth left on the roller 10, moves backward while holding the short-side edge of the cloth, and then moves the cloth in a spread state onto the transfer conveyor 13. The transfer conveyor 13 discharges the spread cloth and, for example, feeds the cloth into the cloth folding machine D in the next step.

Figure 2:
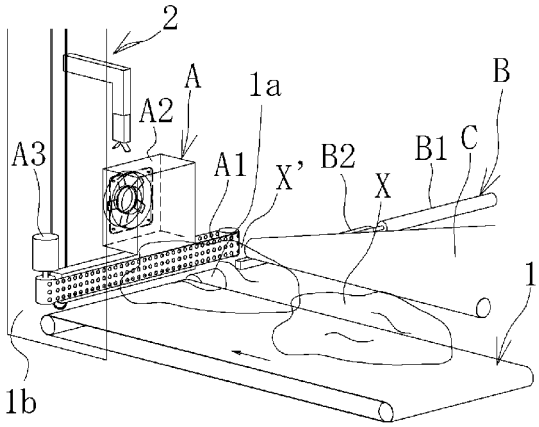
FIG. 2 is an enlarged perspective view of a supply conveyor and a lifting device of the automatic cloth spreading machine of FIG. 1.
Figure 3:
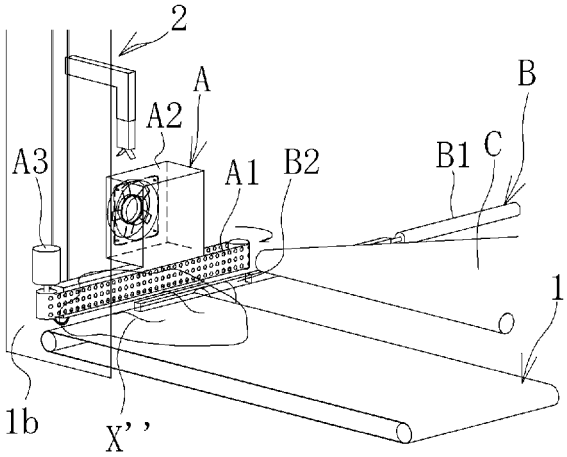
FIG. 3 is an enlarged perspective view of the supply conveyor and the lifting device of the automatic cloth spreading machine of FIG. 1.

Each device will be described in detail. First, as shown in FIG. 1 to FIG. 3, the supply conveyor 1 may be continuously run during operation. A mass of cloth X consisting of, for example, about 10 to 50 washed and dried, still balled-up rectangular pieces of cloth Y is thrown onto the supply conveyor 1. The supply conveyor 1 transfers the mass of cloth X to under the lifting device 2 (indicated by reference sign X' in FIG. 2) by driving a belt by a motor 1*a*. The suction conveyor A is provided at a terminal end of the supply conveyor 1 in a transfer direction. The suction conveyor A is composed of a perforated belt A1, a suction fan A2 that suctions the cloth Y on the supply conveyor 1 through the perforated belt A1, and a motor A3 that drives the perforated belt A1 to rotate and thereby transfers the suctioned cloth Y to directly under the lifting device 2 (indicated by reference sign X" in FIG. 3). A wall 1*b* that prevents the mass of cloth X from falling off the supply conveyor 1 is erected near a terminal end of the perforated belt A1. In addition to or instead of the suction conveyor A, the push-out device B that pushes the cloth on the supply conveyor 1 to directly under the lifting device 2 may be provided at the terminal end of the supply conveyor 1 in the transfer direction. The push-out device B is composed of a cylinder B1 and a push-out rod B2 that is moved forward and backward by the cylinder B1.

The lifting device 2 has a chuck 21 that holds an arbitrary portion of the cloth Y, and an upward-downward moving device that moves the chuck 21 upward and downward. In the shown example, the upward-downward moving device is composed of a driving belt 23 and a motor 22. The upward-downward moving device may have any structure as long as it can move the chuck 21 upward and downward between a predetermined level and a transfer surface of the supply conveyor 1. For example, a chain-driven device or a slider unit that travels upward and downward along a rail may be used. When the chuck 21 of the lifting device 2 is moved by the driving belt 23 and the motor 22 to a lowermost position (the position indicated by the imaginary lines and reference sign 21' in FIG. 4), the chuck 21 comes into contact with the cloth Y located at the terminal end of the supply conveyor 1 and holds the contact portion of the cloth Y. The portion of the cloth held by the chuck 21 may be an arbitrary portion. When the chuck 21 is moved upward, the chuck 21 is raised to a predetermined level (uppermost position) indicated by the solid lines in FIG. 4 while holding the cloth Y, and then holds the cloth Y in a hanging state. Here, two or more pieces of cloth Y may be held and lifted by the chuck 21.

Figure 4:
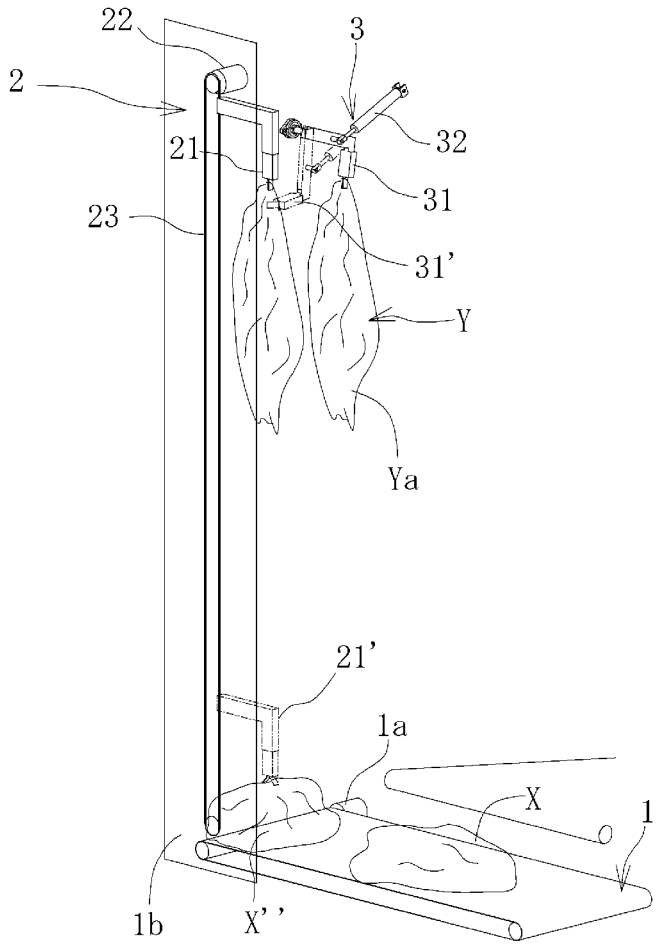
FIG. 4 is an enlarged perspective view of the supply conveyor and the lifting device of the automatic cloth spreading machine of FIG. 1.

As shown in FIG. 1 and FIG. 4, the temporary holding device 3 has a chuck 31 and a forward-backward moving device (extending-contracting cylinder 32) that moves the chuck 31 forward and backward in the front-rear direction. When the chuck 21 of the lifting device 2 moves to the uppermost position, or the cloth Y held by the chuck 21 at the uppermost position is detected by a sensor (not shown), the extending-contracting cylinder 32 of the temporary holding device 3 extends and moves the chuck 31 forward to the position indicated by the imaginary lines (indicated by reference sign 31') in FIG. 4, and the chuck 31 of the temporary holding device 3 receives a portion near an upper end portion of the cloth Y lifted by the lifting device 2. (At this point, the chuck 21 of the lifting device 2 releases the cloth Y.) Thereafter, the extending-contracting cylinder 32 contracts and moves the chuck 31 backward to a predetermined position as indicated by the solid lines in FIG. 4, with the cloth Y hanging from the chuck 31. In most cases, one of corner ends of the cloth appears at a lowermost end (indicated by reference sign Ya in FIG. 4) of the cloth Y hanging from the chuck 31.

As shown in FIG. 5 to FIG. 9, the corner end locating device 4 has: a chuck 41 that receives the cloth Y hung and held by the chuck 31 of the temporary holding device 3 at its backward position; a forward-backward moving device (extending-contracting cylinder 42) that moves the chuck 41 forward and backward in the front-rear direction; a platform 43 on an upper side of which the cloth Y is placed; a sensor 49 that is formed by a phototube, for example, and detects a terminal end portion (corner end Ya) of the cloth Y being dragged over the platform 43; a pressing plate 47 that holds a central portion of the cloth Y on the platform 43 between the pressing plate 47 and the platform 43; an extending-contracting cylinder 48 that moves the pressing plate 47 upward and downward; a pair of corner end locating rollers 44, 45; an extending-contracting cylinder 46 that moves the one corner end locating roller 45 closer to or separated from the other corner end locating roller 44; and a motor 4*b* that rotates the corner end locating roller 44.

Figure 5:
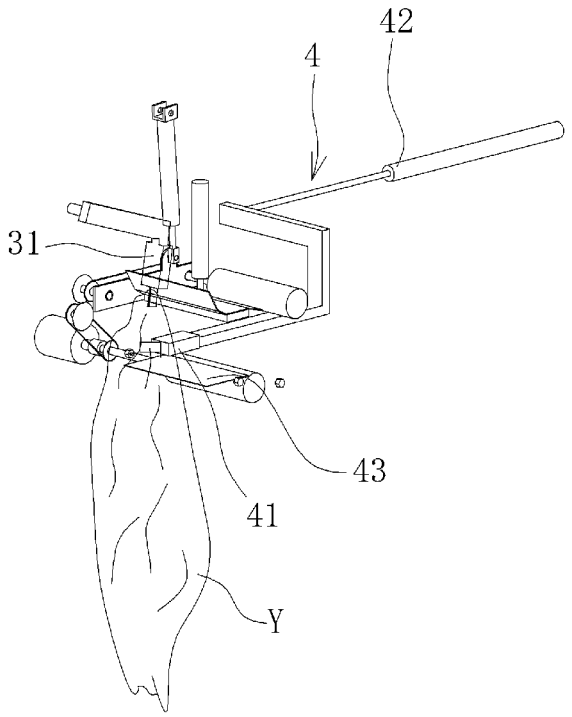
FIG. 5 is an enlarged perspective view of a temporary holding device and a corner end locating device of the automatic cloth spreading machine of FIG. 1.
Figure 6:
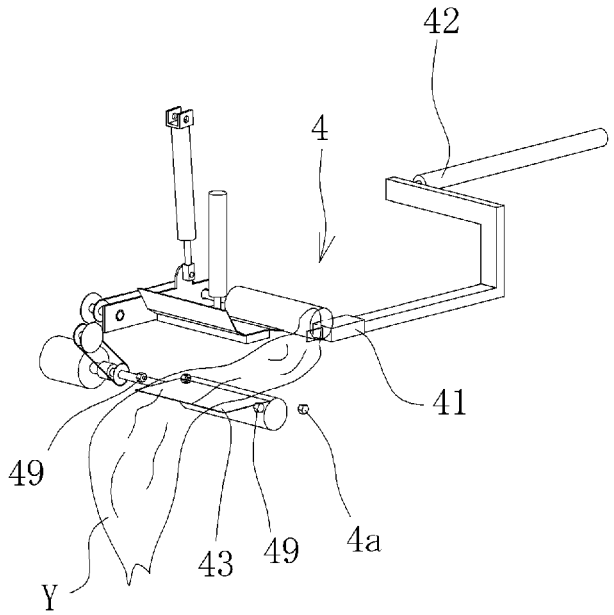
FIG. 6 is an enlarged perspective view of the corner end locating device of the automatic cloth spreading machine of FIG. 1.
Figure 7:
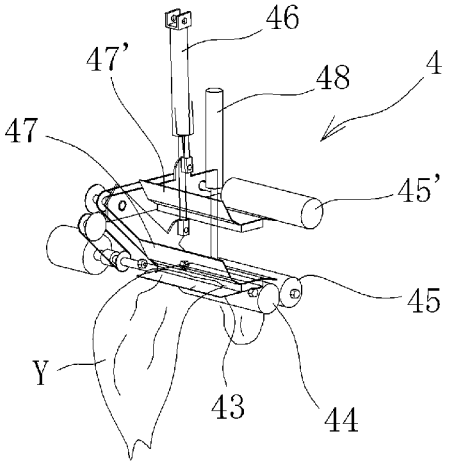
FIG. 7 is an enlarged perspective view of the corner end locating device of the automatic cloth spreading machine of FIG. 1.
Figure 8:
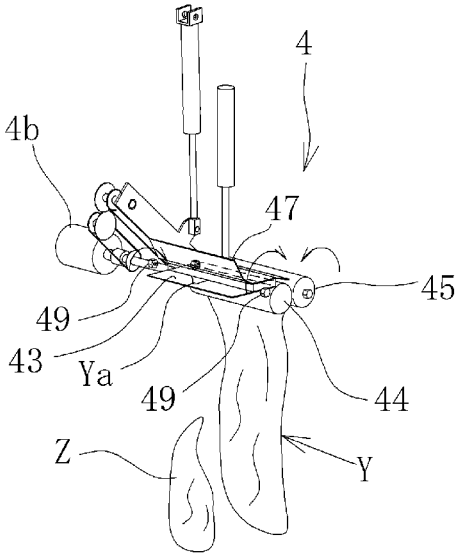
FIG. 8 is an enlarged perspective view of the corner end locating device of the automatic cloth spreading machine of FIG. 1.

When the chuck 31 of the temporary holding device 3 moves to the backward position while holding the cloth Y as shown in FIG. 5, the extending-contracting cylinder 42 of the corner end locating device 4 extends to move the chuck 41 forward, and the chuck 41 receives the cloth Y from the chuck 31 of the temporary holding device 3. Subsequently, as shown in FIG. 6, the extending-contracting cylinder 42 contracts, so that the chuck 41, while holding the cloth Y, pulls in the cloth Y a predetermined distance over the platform 43 before releasing the cloth Y. Then, as shown in FIG. 7, the corner end locating roller 45 located on a far side moves downward from the position indicated by reference sign 45' and catches a leading end portion of the cloth Y between the corner end locating roller 45 and the corner end locating roller 44 on a near side. The pressing plate 47 moves downward from the raised position indicated by reference sign 47' and holds a central portion of the cloth Y between the pressing plate 47 and the platform 43. In this state, as shown in FIG. 8, the corner end locating rollers 44, 45 rotate in the arrow directions, so that the cloth Y droops. When the terminal end portion (forming the corner end Ya) of the cloth Y being dragged over the platform 43 is detected by the sensors 49, 49 (or when the sensors 49, 49 stop detecting the cloth Y), the rotation speed of both the corner end locating rollers 44, 45 is switched to a low speed. When there is a plurality of pieces of cloth Y, pieces of cloth Z other than one piece of cloth Y that is held at the terminal end portion between the platform 43 and the pressing plate 47 will fall in the course of this series of actions. Thereafter, when the terminal end portion (corner end Ya) of the cloth Y is detected by other sensors 4*a*, 4*a* that are formed by phototubes, for example, and disposed between the corner end locating rollers 44, 45 (or when the sensors 4*a*, 4*a* stop detecting the cloth Y), the corner end locating rollers 44, 45 stop rotating, and the corner end Ya or a portion near the corner end Ya of the cloth Y is caught and held between the corner end locating rollers 44, 45, which completes a corner end locating task.

In the shown example, the cloth Y lifted by the lifting device 2 is temporarily held by the temporary holding device 3 and then handed over to the chuck 41 of the corner end locating device 4. In another embodiment (not shown), the temporary holding device 3 may be omitted and the cloth Y lifted by the lifting device 2 may be directly held by the chuck 41 of the corner end locating device 4.

Figure 10:
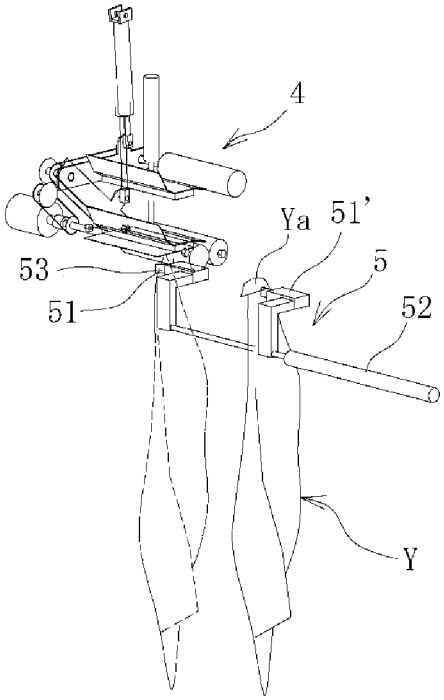
FIG. 10 is an enlarged perspective view of the corner end locating device and a corner end receiving device of the automatic cloth spreading machine of FIG. 1.

As shown in FIG. 10, the corner end receiving device 5 has a chuck 51 disposed under the corner end locating rollers 44, 45, and a forward-backward moving device (extending-contracting cylinder 52) that moves the chuck 51 forward and backward in the left-right direction (see FIG. 1) within a range directly under a contact portion of the corner end locating rollers 44, 45. When the corner end Ya or a portion near the corner end Ya of the cloth Y is being held by the pair of corner end locating rollers 44, 45 of the corner end locating device 4, the extending-contracting cylinder 52 of the corner end receiving device 5 extends and moves the chuck 51 forward in a rightward direction as indicated by the imaginary lines and reference sign 51' in the drawing. The chuck 51' holds the cloth Y at a position a little below the corner end Ya and moves backward toward the left side (toward the horizontal pulling device 6) with the cloth Y drooping from the chuck 51'. A sensor 53 that detects the cloth Y is mounted on the chuck 51. The chuck 51 is activated upon the sensor 53 detecting that the chuck 51 has come close to the cloth Y, so that the chuck 51 can reliably hold the cloth Y.

A platform 64 is provided at a position in the immediate vicinity of a lower rear side of the chuck 51 in a state where the extending-contracting cylinder 52 of the corner end receiving device 5 is contracted. The platform 64 supports a terminal end side of the cloth Y when a portion near the upper end portion (corner end Ya) of the cloth is received and moved rearward by the horizontal pulling device 6 to be described next.

In this reference embodiment, to reveal one corner end Ya of the rectangular cloth Y, the lifting device 2, the temporary holding device 3, and the corner end locating device 4 are used such that the corner end of the rectangular cloth in a balled-up state can be automatically located. Alternatively, this cloth corner end locating task may be performed, for example, by a worker manually finding one corner end of a balled-up piece of cloth Y. In this case, the worker may manually have the found corner end Ya of the cloth received by the chuck 51 of the corner end receiving device 5 or directly received by a chuck 61 of the horizontal pulling device 6 to be described below.

As shown in FIG. 11 to FIG. 14, the horizontal pulling device 6 has the chuck 61 and a forward-backward moving device that moves the chuck 61 forward and backward in the front-rear direction. In the shown example, the forward-backward moving device is composed of a driving belt 63 that holds the chuck 61, and a motor 62 that moves the chuck 61 forward and backward in the front-rear direction by rotating a pulley around which the driving belt 63 is wrapped. However, the forward-backward moving device may have any structure and, for example, an extending-contracting cylinder can also be used.

Figure 11:
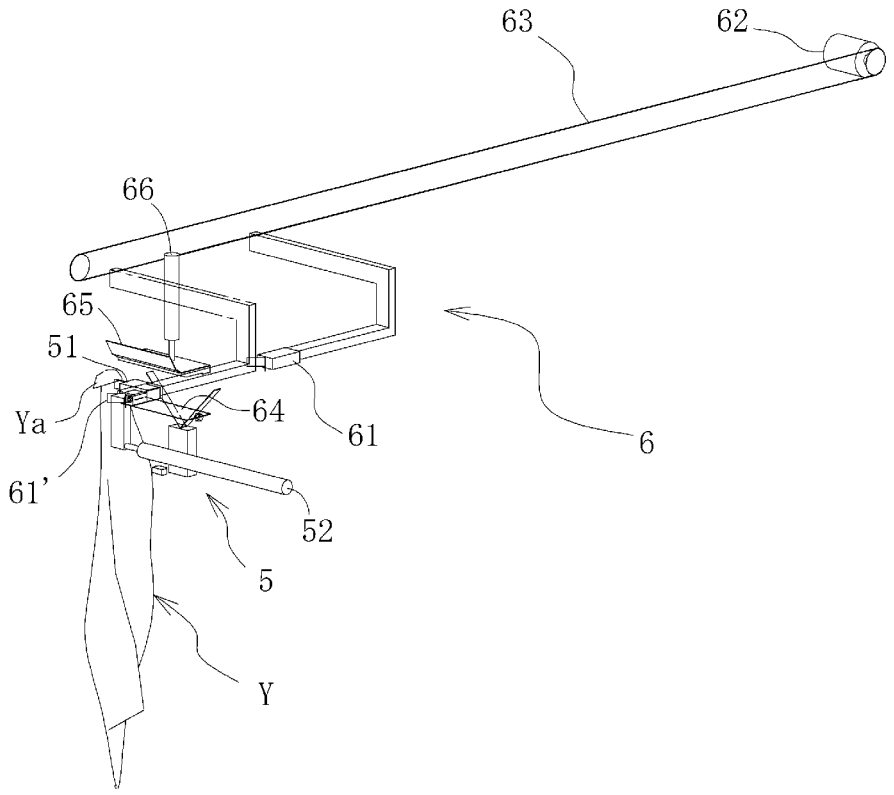
FIG. 11 is an enlarged perspective view of the corner end receiving device and a horizontal pulling device of the automatic cloth spreading machine of FIG. 1.
Figure 12:
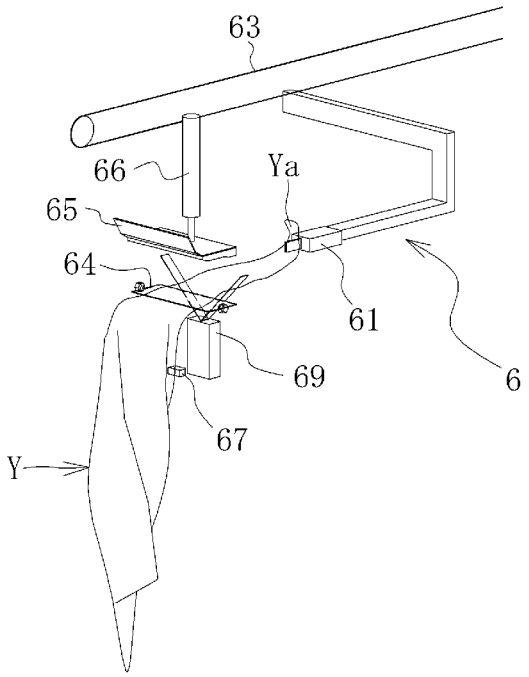
FIG. 12 is an enlarged perspective view of the horizontal pulling device of the automatic cloth spreading machine of FIG. 1.
Figure 13:
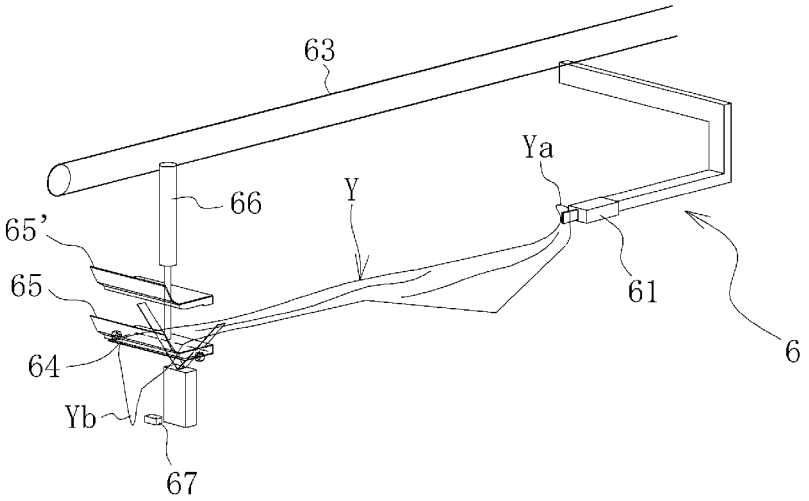
FIG. 13 is an enlarged perspective view of the horizontal pulling device of the automatic cloth spreading machine of FIG. 1.
Figure 14:
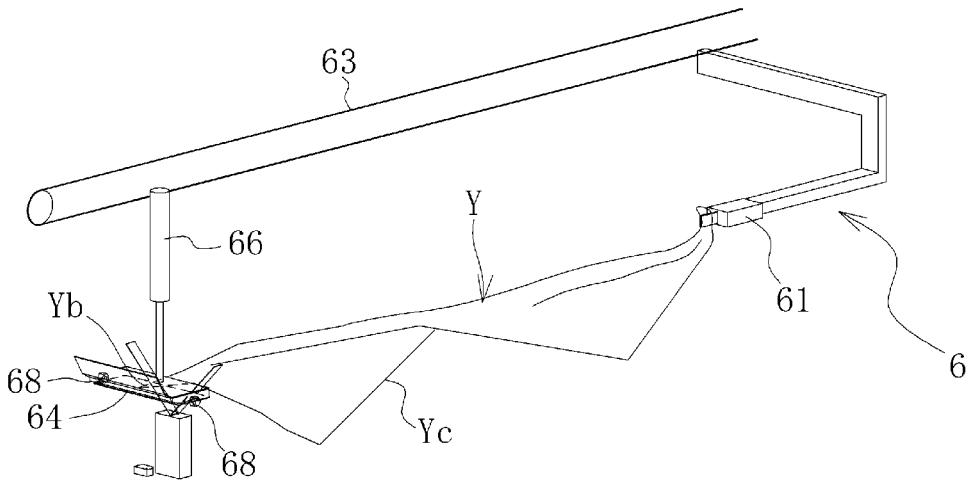
FIG. 14 is an enlarged perspective view of the horizontal pulling device of the automatic cloth spreading machine of FIG. 1.

As shown in FIG. 11, when the chuck 51 of the corner end receiving device 5 holds the cloth Y and moves backward, the chuck 61 of the horizontal pulling device 6 moves forward to the position indicated by the imaginary lines and reference sign 61' in the drawing, and the chuck 61' at this forward position holds the cloth at a position a little below the upper end portion (corner end Ya). Subsequently, after the chuck 51 of the corner end receiving device 5 releases the cloth Y, as shown in FIG. 12, the chuck 61 is moved rearward while holding the cloth at a position near the corner end Ya to thereby pull the cloth Y horizontally over the platform 64. Then, as shown in FIG. 13, after the cloth Y is horizontally pulled a predetermined distance, an upper pressing plate 65 is moved downward by a cylinder 66 from the raised position indicated by reference sign 65' and holds the cloth Y between the upper pressing plate 65 and the platform 64. Also thereafter horizontal pulling continues, and when a sensor 67 disposed under the platform 64 detects a terminal end portion Yb of the cloth Y (or when the sensor 67 stops detecting the cloth Y), the speed of horizontal pulling is switched to a low speed. As shown in FIG. 14, when another sensor 68 disposed near the platform 64 detects the terminal end portion Yb of the cloth Y (or when the sensor 68 stops detecting the cloth Y), horizontal pulling is stopped. Here, the cloth Y is in a state where the two corner ends other than the corner end Ya held by the chuck 61 and the corner end Yb pressed by the upper pressing plate 65 are in line in the front-rear direction and one long-side edge Yc appears in the drooping portion (a state of having a triangular shape).

Figure 15:
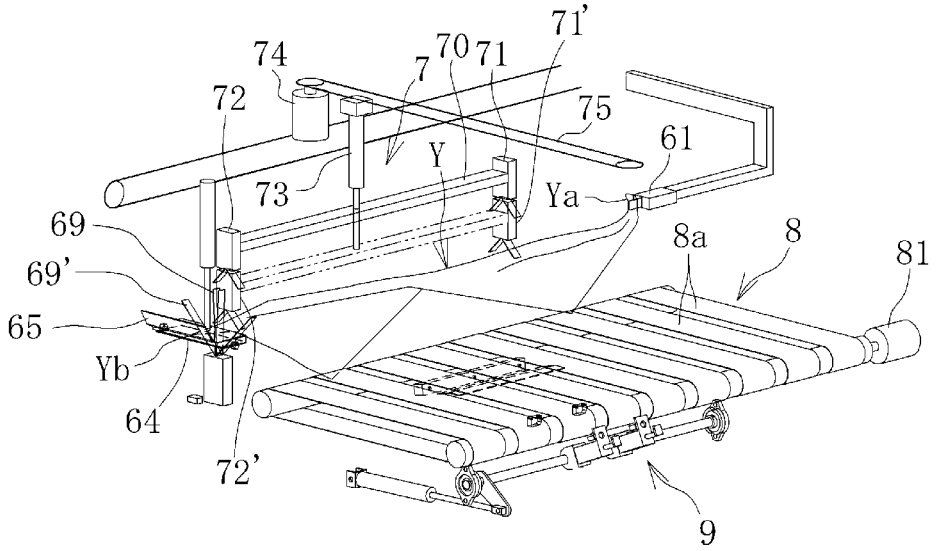
FIG. 15 is an enlarged perspective view of the horizontal pulling device, a two-position holding device, an edge locating conveyor, and a vertically inverting device of the automatic cloth spreading machine of FIG. 1.

As shown in FIG. 15, the edge locating conveyor 8 that is driven by a motor 81 is installed to the right of the platform 64 and the upper pressing plate 65. The edge locating conveyor 8 is formed by a plurality of (in the shown example, nine) thin belts **8*a*** extending in the left-right direction that is disposed at intervals in the front-rear direction.

As shown in FIG. 15 to FIG. 20, the two-position holding device 7 has: two chucks 71, 72 (hereinafter also referred to as an intermediate portion holding chuck 71 and a corner end holding chuck 72) mounted respectively at a rear end and a front end of a coupling rod 70 that extends in the front-rear direction; an upward-downward moving cylinder 73 that moves the chucks 71, 72 upward and downward; and a forward-backward moving device that moves the chucks 71, 72, together with the upward-downward moving cylinder 73, forward and backward in the left-right direction. The forward-backward moving device is composed of a driving belt 75 that holds the upward-downward moving cylinder 73 in a vertical state, and a motor 74 that rotates a pulley wrapped around the driving belt 75. However, the forward-backward moving device may have any structure as long as it can move the chucks 71, 72 in the left-right direction, and a forward-backward moving cylinder may also be used. The distance between the chucks 71, 72 may be made appropriately changeable according to the size etc. of the cloth Y to be processed, for example, by using a length-adjustable coupling rod 70 or adopting a structure that allows changes in the mounting positions of the chucks 71, 72 on the coupling rod 70.

As shown in FIG. 15, the corner end holding chuck 72 is located at a position at which it can hold a front-side end portion (corner end) Yb of the cloth Y laid by the horizontal pulling device 6, while the intermediate portion holding chuck 71 is located at a position at which it can hold an appropriate portion of an intermediate portion on the rear side of the laid cloth Y.

In its contracted state, the upward-downward moving cylinder 73 keeps the chucks 71, 72 on standby at positions above the laid cloth Y (the state indicated by the solid lines in FIG. 15), and in its extended state, the upward-downward moving cylinder 73 moves the chucks 71, 72 downward to positions at which they can hold an upper edge of the laid cloth Y as indicated by the imaginary lines and reference signs 71', 72' in FIG. 15.

Figure 16:
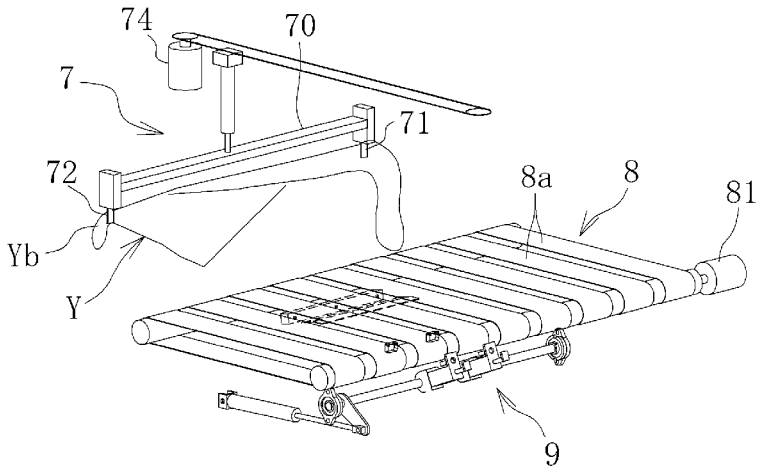
FIG. 16 is an enlarged perspective view of the two-position holding device, the edge locating conveyor, and the vertically inverting device of the automatic cloth spreading machine of FIG. 1.
Figure 17:
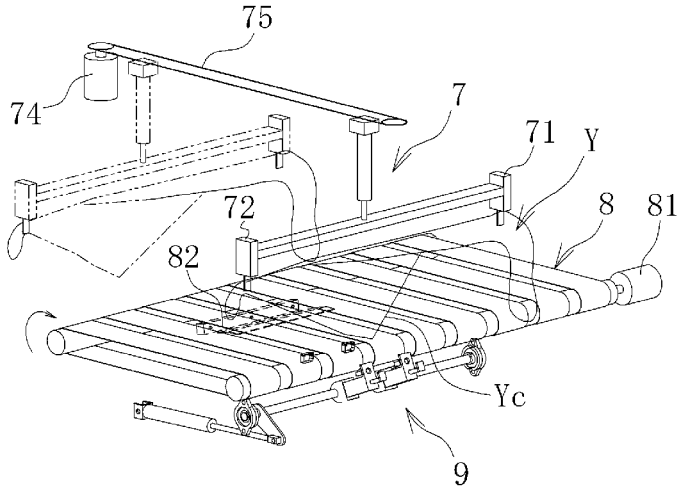
FIG. 17 is an enlarged perspective view of the two-position holding device, the edge locating conveyor, and the vertically inverting device of the automatic cloth spreading machine of FIG. 1.

When the upward-downward moving cylinder 73 extends and the two-position holding device 7 moves downward, as shown in FIG. 16, the corner end holding chuck 72 holds the front-side end portion (corner end Yb) of the cloth Y and the intermediate portion holding chuck 71 holds the intermediate portion on the rear side of the cloth Y. Here, as shown in FIG. 15, the opening degree of the chuck 69 provided near the rear side of the upper pressing plate 65 can be reduced from the wide-open state indicated by reference sign 69' to help the corner end holding chuck 72 hold the cloth Y. Thereafter, the cloth Y is released from the chuck 61, the upper pressing plate 65, and the chuck 69 of the horizontal pulling device 6 that have been holding or restraining the cloth Y. Then, as shown in FIG. 17, the two-position holding device 7 is moved by the forward-backward moving device from a position above the edge locating conveyor 8 toward a terminal end side of the edge locating conveyor 8. The belts of the edge locating conveyor 8 have moved in the arrow direction indicated in FIG. 17, and a triangular portion (a portion near the side edge Yc) of the cloth Y can come into contact with the edge locating conveyor 8. Air blown by a blowing device 82 installed between upper and lower portions of the belts of the edge locating conveyor 8 causes this triangular portion to trail in a flow direction of (move along) the edge locating conveyor 8.

Figure 18:
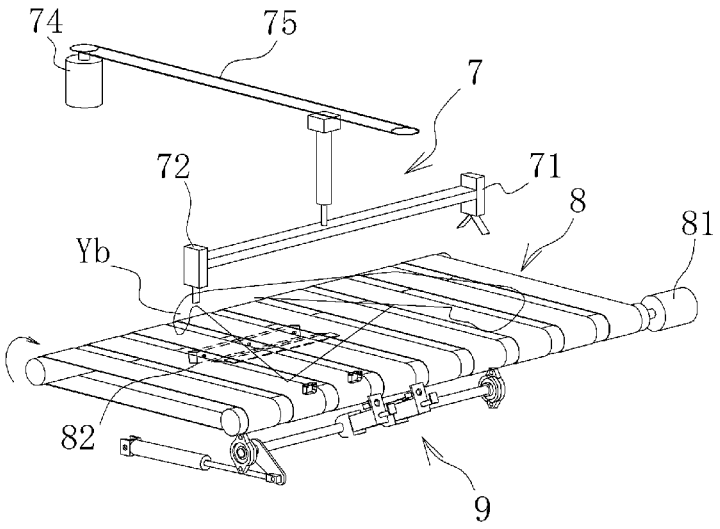
FIG. 18 is an enlarged perspective view of the two-position holding device, the edge locating conveyor, and the vertically inverting device of the automatic cloth spreading machine of FIG. 1.
Figure 19:
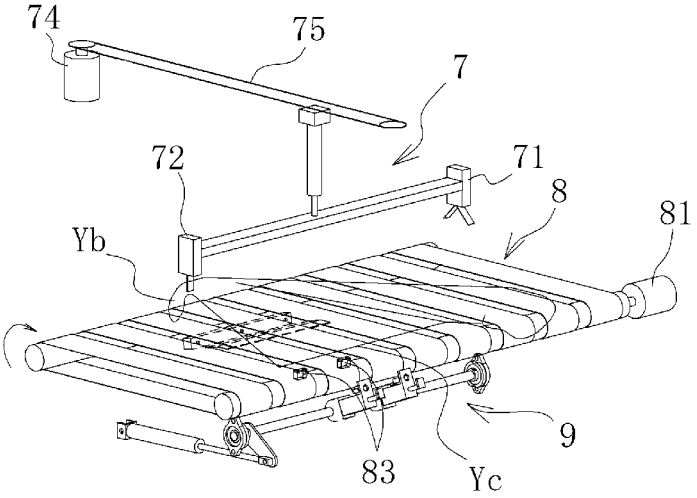
FIG. 19 is an enlarged perspective view of the two-position holding device, the edge locating conveyor, and the vertically inverting device of the automatic cloth spreading machine of FIG. 1.
Figure 20:
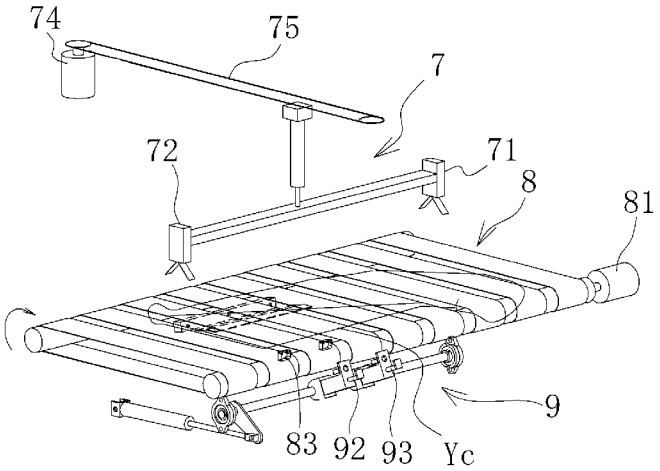
FIG. 20 is an enlarged perspective view of the two-position holding device, the edge locating conveyor, and the vertically inverting device of the automatic cloth spreading machine of FIG. 1.

Subsequently, as shown in FIG. 18, the chuck 71 on the rear side of the two-position holding device 7 releases the cloth Y, so that one-side part of the cloth Y (a part on the rear side from the corner end Yb) falls onto the moving belts of the edge locating conveyor 8. Since the front-side end portion (corner end Yb) of the cloth Y is still held by the corner end holding chuck 72, only the fallen portion of the cloth Y moves rightward as shown in FIG. 19. When this fallen portion of the cloth Y has moved a predetermined distance, the one long-side edge Yc of the cloth Y is disposed substantially orthogonal to the flow direction of the edge locating conveyor 8. When the long-side edge Yc is thus disposed, as shown in FIG. 20, the other chuck 72 releases the cloth Y, so that the entire cloth Y falls onto the edge locating conveyor 8. Two sensors 83 that detect the leading-side edge Yc of the cloth Y being transferred on the edge locating conveyor 8 are installed near a terminal end of the edge locating conveyor 8, and the edge locating conveyor 8 is switched to a low speed when the sensors 83 detect the cloth Y.

Figure 21:
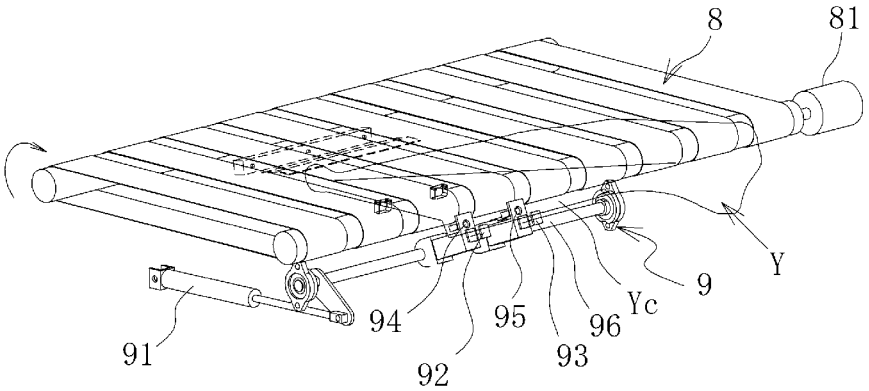
FIG. 21 is an enlarged perspective view of the edge locating conveyor and the vertically inverting device of the automatic cloth spreading machine of FIG. 1.
Figure 22:
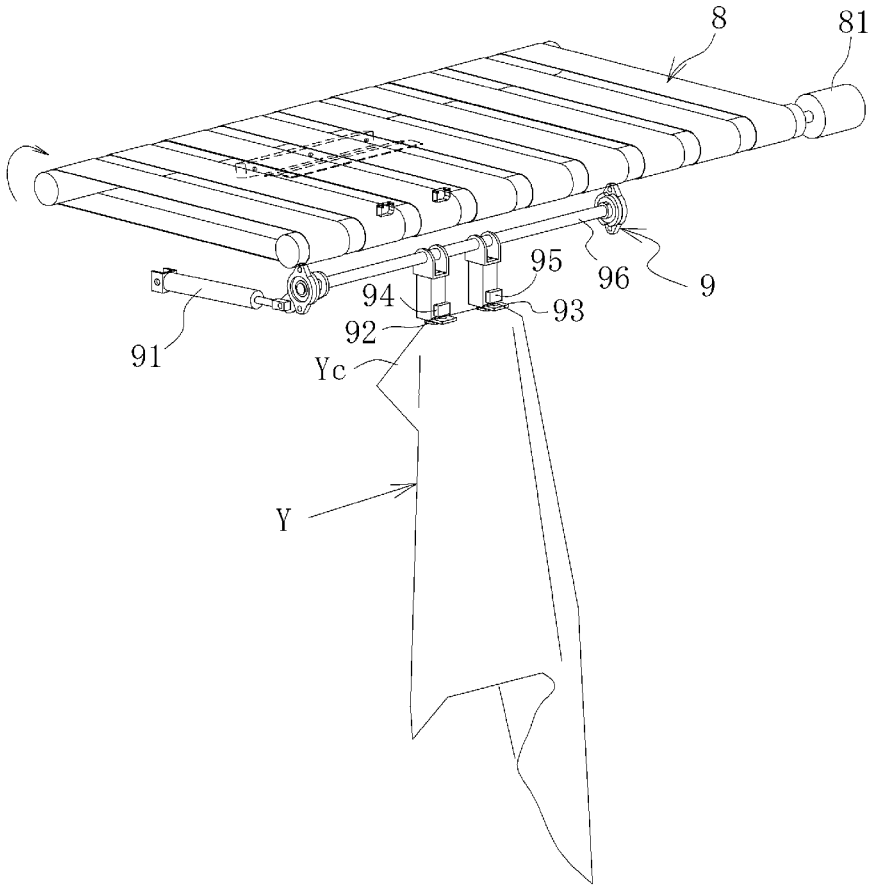
FIG. 22 is an enlarged perspective view of the edge locating conveyor and the vertically inverting device of the automatic cloth spreading machine of FIG. 1.

As shown in FIG. 21, the vertically inverting device 9 has: two chucks 92, 93 that are disposed near the terminal end of the edge locating conveyor 8 and hold the one long-side edge Yc of the cloth Y; two sensors 94, 95 provided near the chucks 92, 93; a reversing shaft 96 that supports the chucks 92, 93; and a turning cylinder 91 that turns the reversing shaft 96. Any mechanism may be used that can reverse the cloth Y held by the two chucks 92, 93, and instead of the turning cylinder 91, a motor that rotates the reversing shaft 96 in normal and reverse directions may also be used. The two chucks 92, 93 are configured to move independently of each other based on signals of the sensors 94, 95 detecting the side edge Yc of the cloth Y, and the side edge Yc of the cloth Y can be thereby held straight between the two chucks 92, 93.

The vertically inverting device 9 operates as follows: First, until the leading-side edge Yc of the cloth being transferred on the edge locating conveyor 8 is detected by the sensors 94, 95, the chucks 92, 93 remain on standby in a substantially horizontal (slightly upward-inclined) posture as shown in FIG. 20. When the leading-side edge Yc of the cloth Y being transferred on the edge locating conveyor 8 is detected by the sensors 94, 95, the chucks 92, 93 hold the leading-side edge Yc of the cloth based on detection signals from the sensors 94, 95. Immediately thereafter, the turning cylinder 91 contracts and causes the chucks 92, 93 to turn downward at a high speed while holding the side edge Yc of the cloth, thus assuming the downward-facing posture shown in FIG. 22. Here, the cloth Y having been held by the chucks 92, 93 is rapidly swung down (an unfurling action is exerted on the cloth in a short-side direction), so that the cloth Y droops. The chucks 92, 93 holding the side edge Yc of the cloth in the downward-facing posture release the held portions of the side edge Yc when these portions are passed to chucks 111, 112 of the hanging device 11 to be described below, and immediately thereafter are turned upward and returned to the original standby positions.

Figure 23:
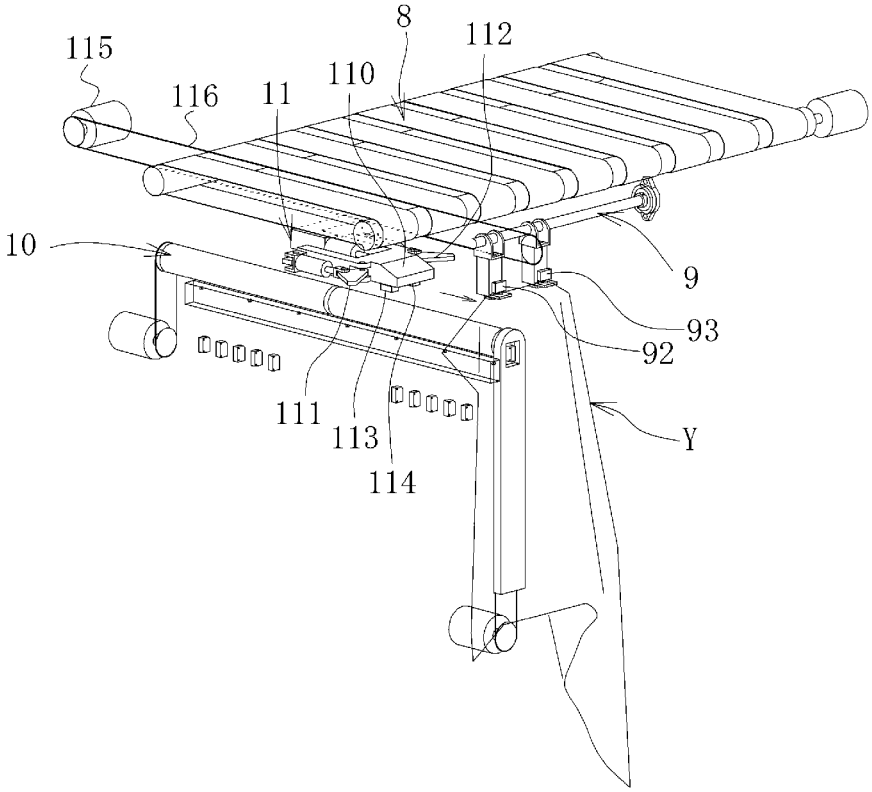
FIG. 23 is an enlarged perspective view of the edge locating conveyor, the vertically inverting device, a roller, and a hanging device of the automatic cloth spreading machine of FIG. 1.

As shown in FIG. 23, the roller 10 and the hanging device 11 that hangs the cloth Y on the roller 10 are installed directly under a front-side portion of the edge locating conveyor 8, with the hanging device 11 located on the upper side and the roller 10 on the lower side.

The hanging device 11 has a forward-backward moving platform 110 facing the vertically inverting device 9, the two chucks 111, 112 that are disposed on each side of the forward-backward moving platform 110 and receive the cloth Y from the chucks 92, 93 of the vertically inverting device 9, and chuck sensors 113, 114. The hanging device 11 is moved forward and backward in the left-right direction (in the direction of a rotational axis of the roller 10) by a forward-backward moving device. In the shown example, the forward-backward moving device is composed of a driving belt 116 that holds the forward-backward moving platform 110 and a motor 115 that rotates a pulley around which the driving belt 116 is wrapped. However, the forward-backward moving device may have any structure as long as it can move the chucks 111, 112 forward and backward in the left-right direction, and, for example, a forward-backward moving cylinder may also be used.

Figure 24:
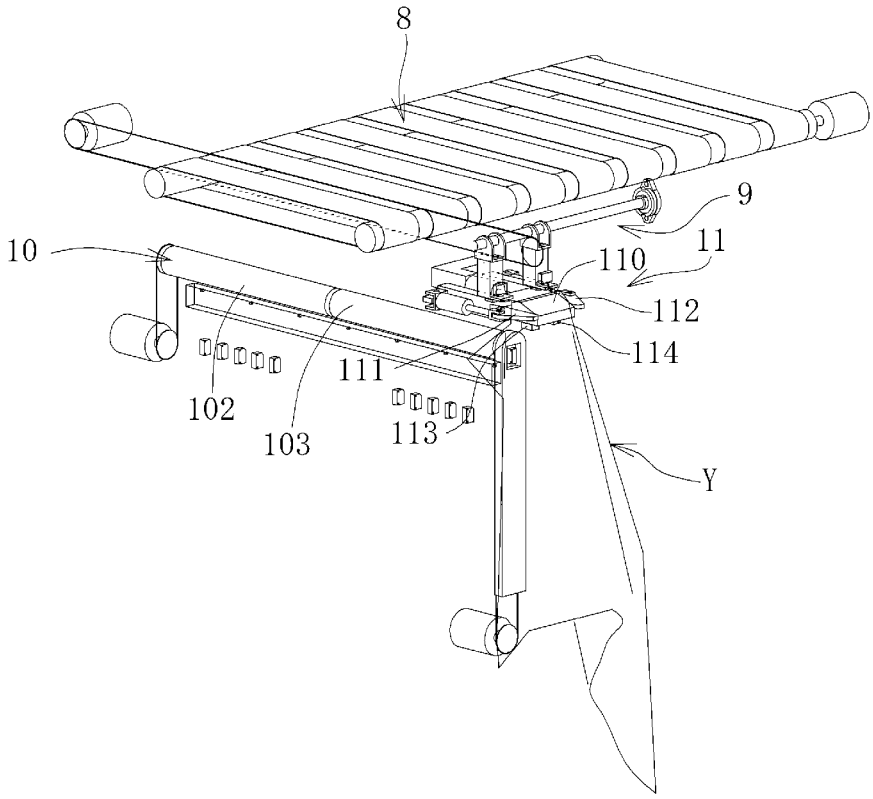
FIG. 24 is an enlarged perspective view of the edge locating conveyor, the vertically inverting device, the roller, and the hanging device of the automatic cloth spreading machine of FIG. 1.
Figure 25:
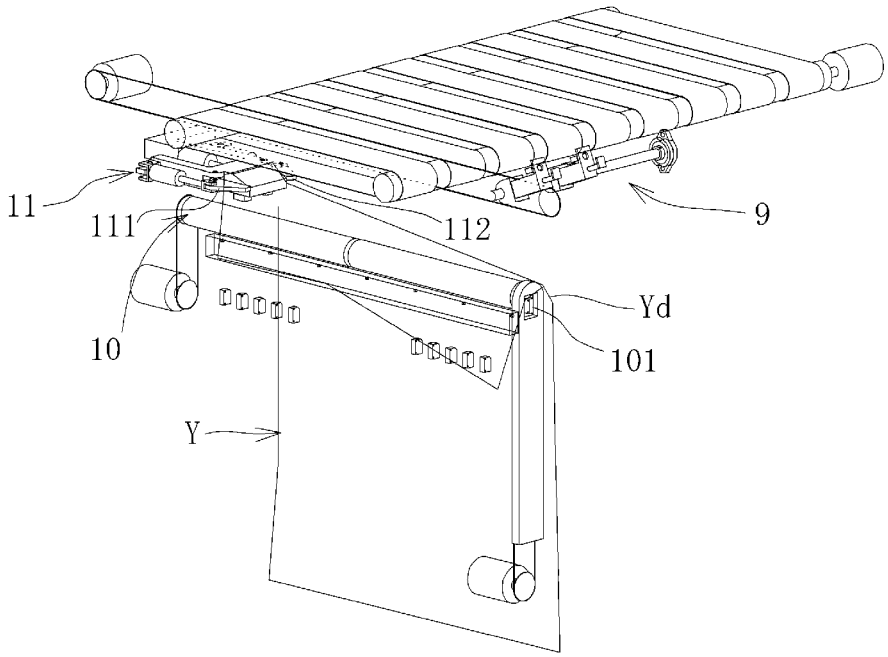
FIG. 25 is an enlarged perspective view of the edge locating conveyor, the vertically inverting device, the roller, and the hanging device of the automatic cloth spreading machine of FIG. 1.

The hanging device 11 moves closer to the cloth Y held by the vertically inverting device 9 from the standby position shown in FIG. 23. As shown in FIG. 24, when the chuck sensors 113, 114 detect the cloth Y, the chucks 111, 112 are closed toward both sides of the forward-backward moving platform 110 and hold the cloth Y. Here, the position at which the chucks 111, 112 hold the cloth Y is a position near the position at which the chucks 92, 93 of the vertically inverting device 9 hold the cloth Y. The two chucks 111, 112 may be configured to move separately and independently, and in that case, the portion of the side edge Yc of the cloth Y between the two chucks 111, 112 can be held straighter. As shown in FIG. 25, after passing the cloth Y, the vertically inverting device 9 turns around and returns to the original position, and moves away from the path of the hanging device 11. Since the roller 10 is disposed such that the rotational axis thereof is parallel to the forward-backward moving direction of the hanging device 11, when the hanging device 11 holding the cloth Y in a drooping state moves backward, as shown in FIG. 25, the cloth Y is hung on the roller 10 and droops from the roller 10. Here, a side edge Yd on the opposite side from the long-side edge Yc held by the chucks 111, 112 is detected by a sensor 101, and the chucks 111, 112 release the cloth Y after a predetermined time has elapsed since the detection. The predetermined time is appropriately set such that the chucks 111, 112 release the cloth Y when the center of the cloth Y in a width direction thereof substantially coincides with the center of the roller 10 in a width direction thereof. The hanging device 11 continues to move backward a predetermined distance also after the chucks 111, 112 release the cloth Y.

Figure 26:
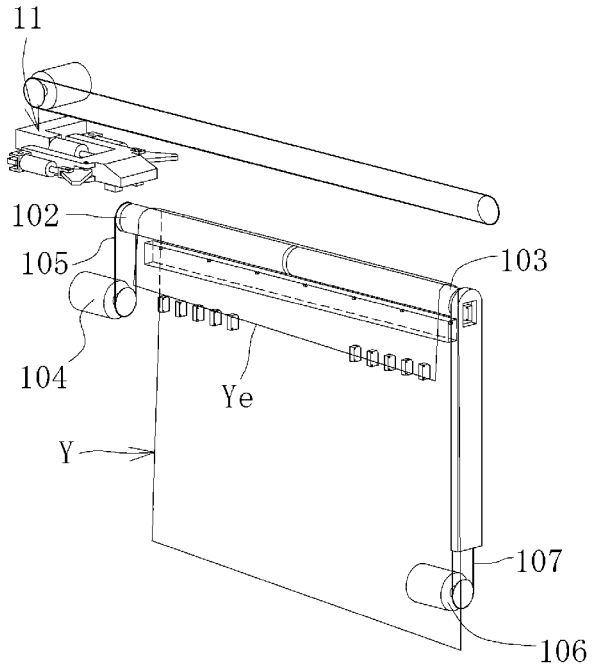
FIG. 26 is an enlarged perspective view of the roller and the hanging device of the automatic cloth spreading machine of FIG. 1.
Figure 27:
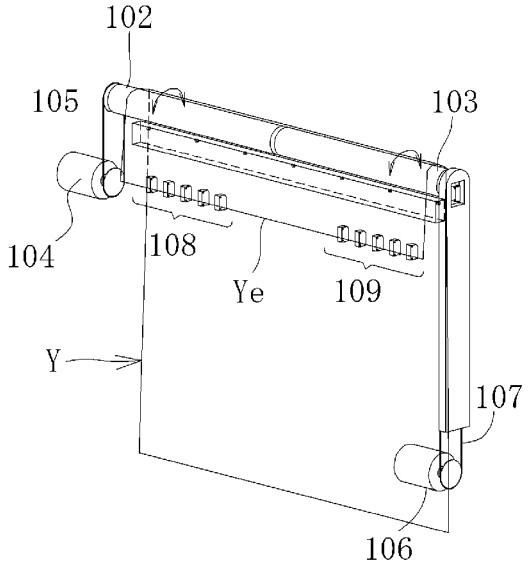
FIG. 27 is an enlarged perspective view of the roller of the automatic cloth spreading machine of FIG. 1.

As shown in FIG. 26, the roller 10 is composed of a first roller part 102 and a second roller part 103 disposed next to each other on the same axis. The first roller part 102 is connected to a motor 104 through a driving belt 105 and driven to rotate by the motor 104. The second roller part 103 is connected to a motor 106 through a driving belt 107 and driven to rotate by the motor 106. The rotation directions and the rotation speeds of the motors 104, 106 can be controlled separately and independently, and are preferably controlled separately and independently such that the direction of the cloth Y on the roller 10 can be corrected to the right direction (e.g., a direction in which a long-side direction of the cloth Y coincides with the front-rear direction) based on detection signals from a plurality of sensor groups 108, 109 that is arrayed under the roller parts 102, 103, parallel to the rotational axis of the rollers as shown in FIG. 27. For example, when the cloth Y is obliquely hung on the roller 10 as shown in FIG. 26, and only the sensor group 109 of the sensor groups 108, 109 detects a short-side edge Ye of the cloth Y as shown in FIG. 27, the first roller part 102 and the second roller part 103 are repeatedly stopped, rotated in a normal direction, and rotated in a reverse direction based on a detection result of the sensor group 109, until the side edge Ye becomes parallel to the sensor groups 108, 109 and both the sensor groups 108, 109 detect the short-side edge Ye of the cloth Y at the same time. In the shown example, each of the sensor groups 108, 109 consists of five sensors. However, the number of the sensors is not limited to five, and four or less or six or more sensors may be provided according to the width of the cloth Y to be processed, and the sensors to be activated may be switched according to the cloth Y to be processed.

Figure 28:
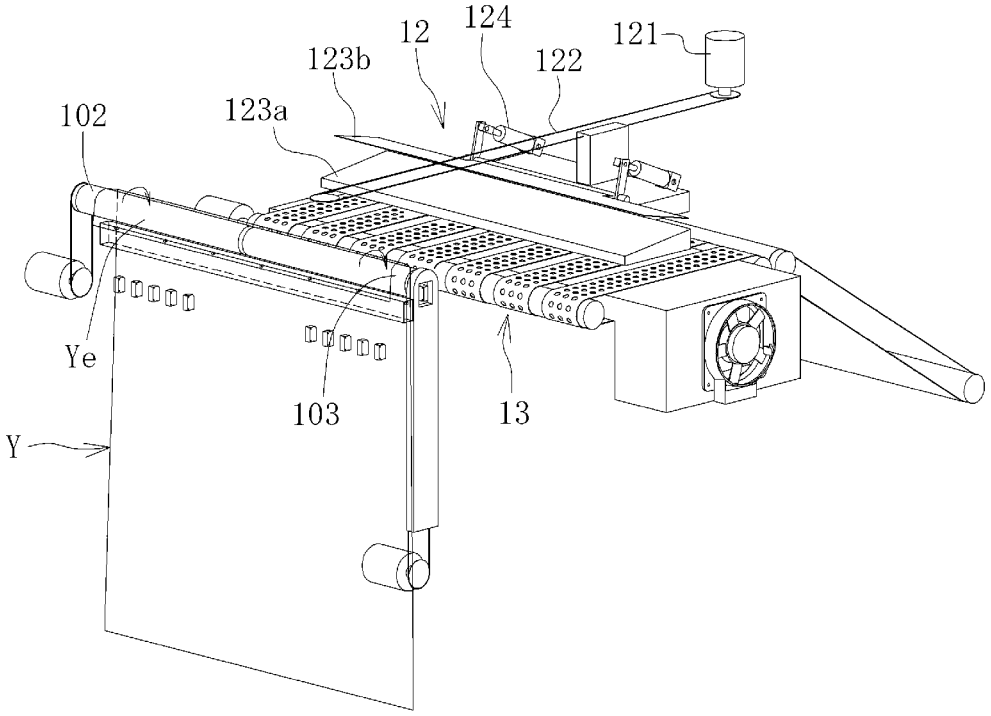
FIG. 28 is an enlarged perspective view of the roller, a forward-backward moving device, and a transfer conveyor of the automatic cloth spreading machine of FIG. 1.

The forward-backward moving device 12 moves the cloth Y having been oriented in the right direction on the roller 10 onto the transfer conveyor 13. As shown in FIG. 28, the forward-backward moving device 12 has a clamp unit that has a clamp width larger than the width of the cloth Y and holds a short-side end portion of the cloth Y, and a forward-backward moving mechanism that moves the clamp unit forward and backward in the front-rear direction. In this reference embodiment, the clamp unit is composed of an inclined holding platform 123*a* facing the roller 10, and a holding plate 123*b* that is opened from and closed onto the holding platform 123*a* by a cylinder or the like. The forward-backward moving mechanism is composed of a driving belt 122 that is coupled to the holding platform 123*a* and a motor 121 that rotates a pulley around which the driving belt 122 is wrapped. However, a forward-backward moving cylinder may also be used.

Figure 29:
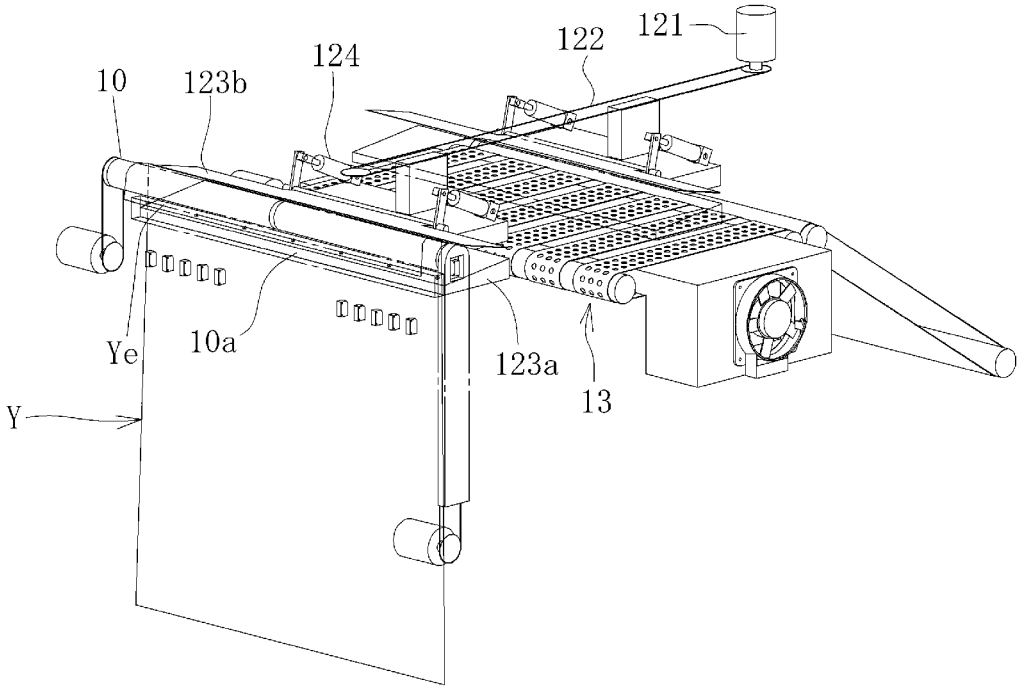
FIG. 29 is an enlarged perspective view of the roller, the forward-backward moving device, and the transfer conveyor of the automatic cloth spreading machine of FIG. 1.
Figure 30:
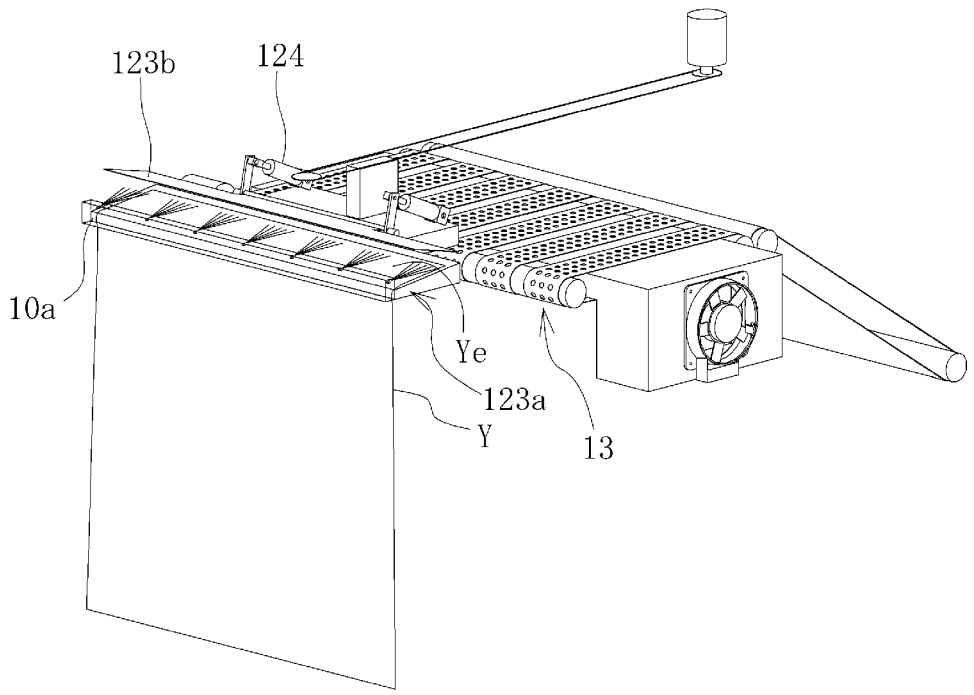
FIG. 30 is an enlarged perspective view of the forward-backward moving device and the transfer conveyor of the automatic cloth spreading machine of FIG. 1.
Figure 31:
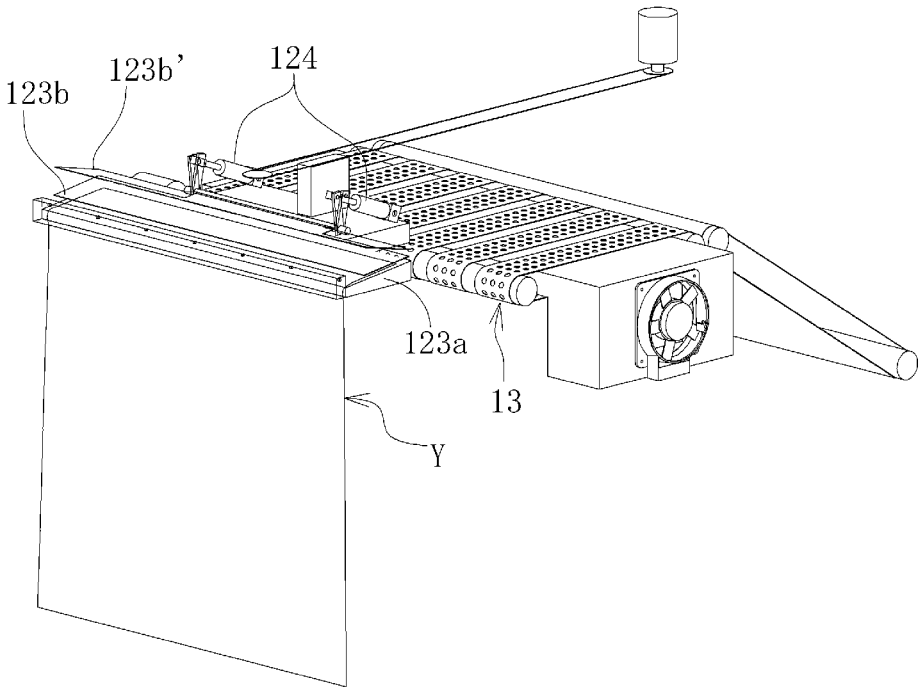
FIG. 31 is an enlarged perspective view of the forward-backward moving device and the transfer conveyor of the automatic cloth spreading machine of FIG. 1.
Figure 32:
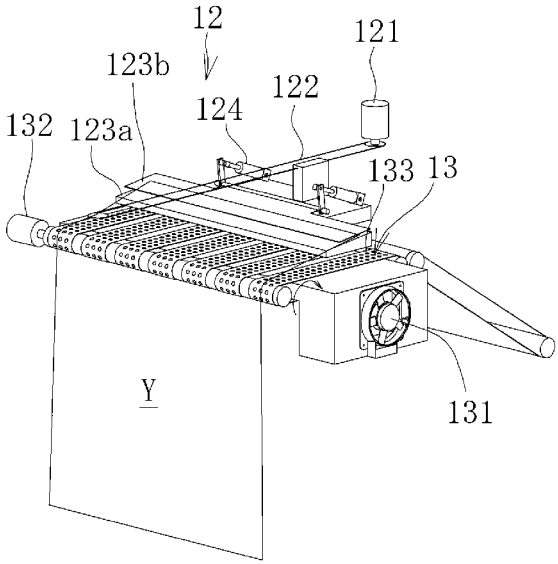
FIG. 32 is an enlarged perspective view of the forward-backward moving device and the transfer conveyor of the automatic cloth spreading machine of FIG. 1.
Figure 33:
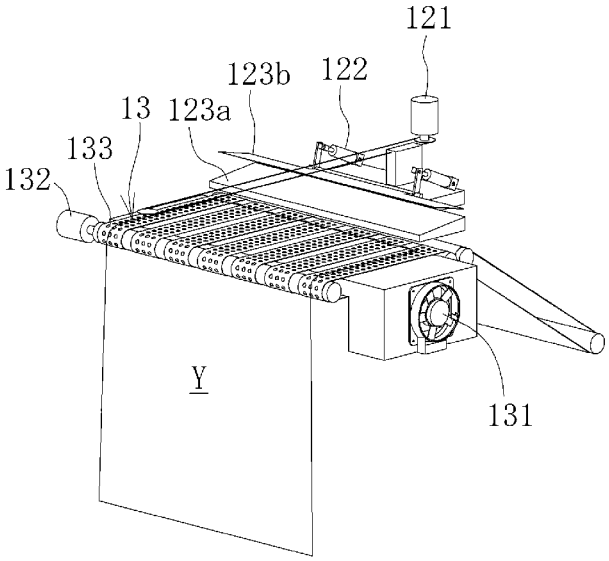
FIG. 33 is an enlarged perspective view of the forward-backward moving device and the transfer conveyor of the automatic cloth spreading machine of FIG. 1.

To move the cloth Y from the roller 10 onto the transfer conveyor 13 by the forward-backward moving device 12, as shown in FIG. 28, the first roller part 102 and the second roller part 103 are rotated toward the forward-backward moving device 12 at the same time and at the same speed, so that the side edge Ye of the cloth Y located near the sensor groups 108, 109 is moved closer to the forward-backward moving device 12. Further, as shown in FIG. 29, the clamp unit of the forward-backward moving device 12 is moved forward, and a leading end of the holding platform 123*a* of the clamp unit with the holding plate 123*b* opened is pressed against a blowing member 10*a* installed under the roller 10, so as to sandwich a portion of the cloth Y on the roller 10, which is a portion on the side of the transfer conveyor 13, between the leading end of the holding platform 123*a* and the blowing member 10*a*. In this state, as shown in FIG. 30, air is ejected from the blowing member 10*a* and, at the same time, the first roller part 102 and the second roller part 103 are further rotated toward the forward-backward moving device 12. As a result, the side edge Ye of the cloth Y is placed on the holding platform 123*a*. Thereafter, as shown in FIG. 31, the holding plate 123*b* is closed and the side edge Ye of the cloth Y is held between the holding plate 123*b* and the holding platform 123*a*. The portion of the cloth Y other than the portion held between the holding platform 123*a* and the holding plate 123*b* of the clamp unit droops from the holding platform 123*a*. In this state, as shown in FIG. 32, the clamp unit of the forward-backward moving device 12 is moved toward the transfer conveyor 13. After the clamp unit is moved backward a predetermined distance, as shown in FIG. 33, the holding plate 123*b* is opened again and the cloth Y is moved onto the transfer conveyor 13. The clamp unit of the forward-backward moving device 12 continues to be moved backward a predetermined distance also after the holding plate 123*b* releases the cloth Y.

Figure 34:
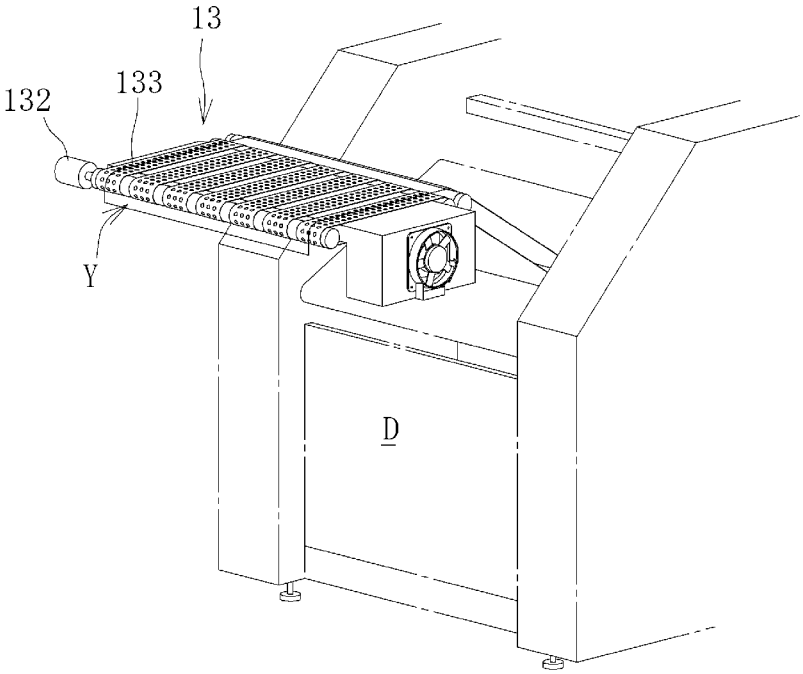
FIG. 34 is an enlarged perspective view of the transfer conveyor of the automatic cloth spreading machine of FIG. 1 and a cloth folding machine in the next step.

As shown in FIG. 34, the transfer conveyor 13 has a belt 133 having a large number of through-holes, a motor 132 that drives the belt 133, and a suction fan 131 that suctions the cloth Y on the belt 133 through the through-holes formed in the belt 133. As the cloth Y on the transfer conveyor 13 is thus suctioned, the side edge Ye of the cloth Y held by the clamp unit of the forward-backward moving device 12 can fall and smoothly move onto the transfer conveyor 13. Thereafter, the transfer conveyor 13 discharges the cloth Y and transfers (feeds) the cloth Y to the next step (here, the cloth folding machine D). The belt 133 of the transfer conveyor 13 need not be driven while the clamp unit of the forward-backward moving device 12 moves the cloth Y onto the transfer conveyor 13. However, it is preferable that the belt 133 be driven from the viewpoint of increasing the number of pieces processed.

The automatic cloth spreading machine of the reference embodiment configured as described above requires simply feeding washed and dried cloth Y onto the supply conveyor 1. Then, the cloth Y can be automatically spread and transferred (fed) to the next step by the supply conveyor 1, the lifting device 2, the temporary holding device 3, the corner end locating device 4, the corner end receiving device 5, the horizontal pulling device 6, the two-position holding device 7, the edge locating conveyor 8, the vertically inverting device 9, the roller 10, the hanging device 11, the forward-backward moving device 12, and the transfer conveyor 13.

Thus, in the automatic cloth spreading machine of this reference embodiment, the supply conveyor 1, the lifting device 2, the temporary holding device 3, the corner end locating device 4, and the corner end receiving device 5 constitute a separating means for separating pieces of cloth Y one by one from a mass of cloth X consisting of a plurality of pieces of cloth Y; the horizontal pulling device 6, the two-position holding device 7, the edge locating conveyor 8, and the vertically inverting device 9 constitute an edge locating means for locating an edge of each of the pieces of cloth Y having been separated one by one; the roller 10, the hanging device 11 and the forward-backward moving device 12 a constitute spreading means for spreading the piece of cloth Y, the edge of which has been located; and the transfer conveyor 13 constitutes a discharging means for discharging the piece of cloth Y having been spread to a subsequent step.

Figure 35:
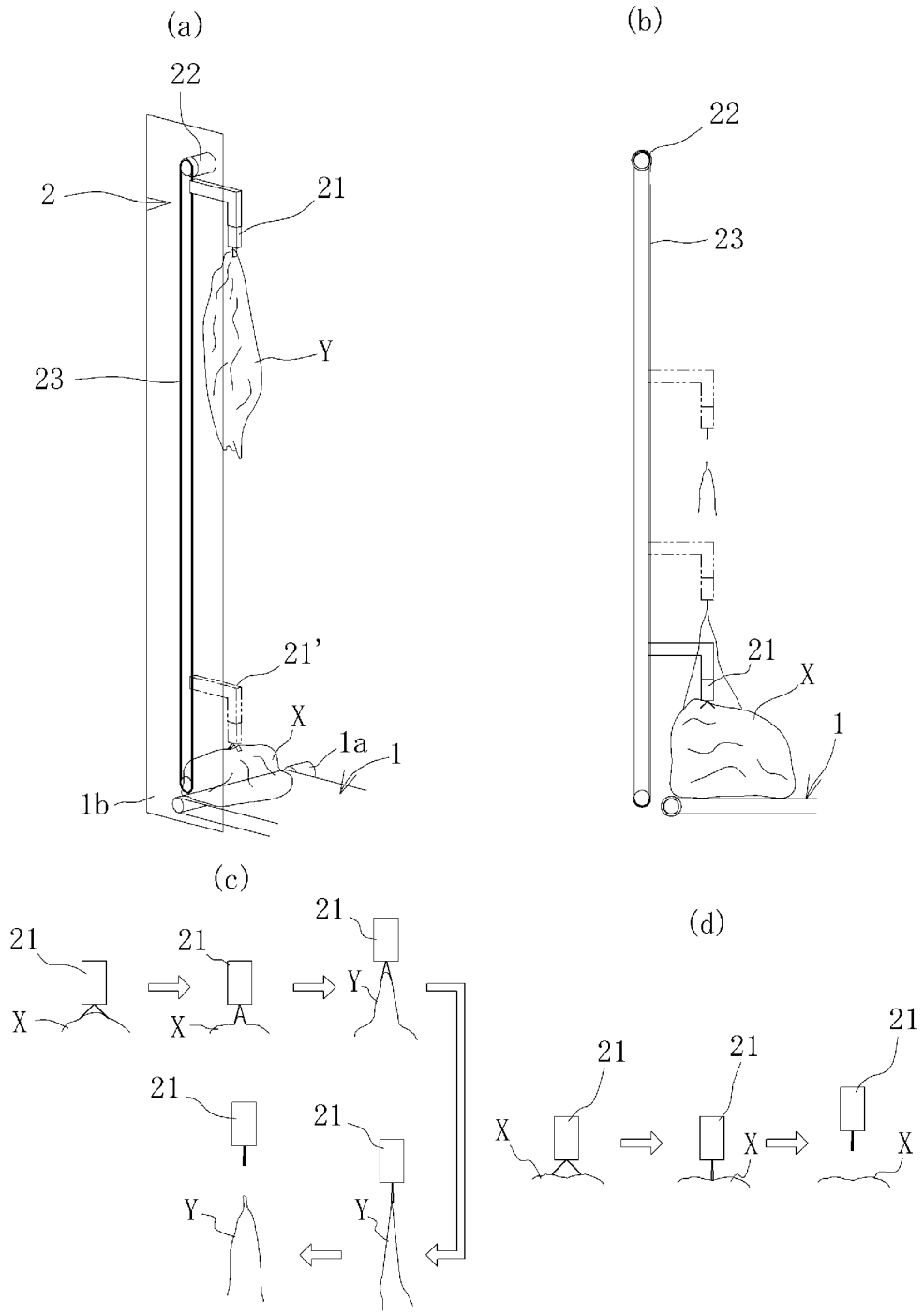
FIG. 35 (*a*) is an enlarged perspective view showing an example of successful handling by a chuck of the lifting device as a cloth handling device of the automatic cloth spreading machine of FIG. 1.
Figure 36:
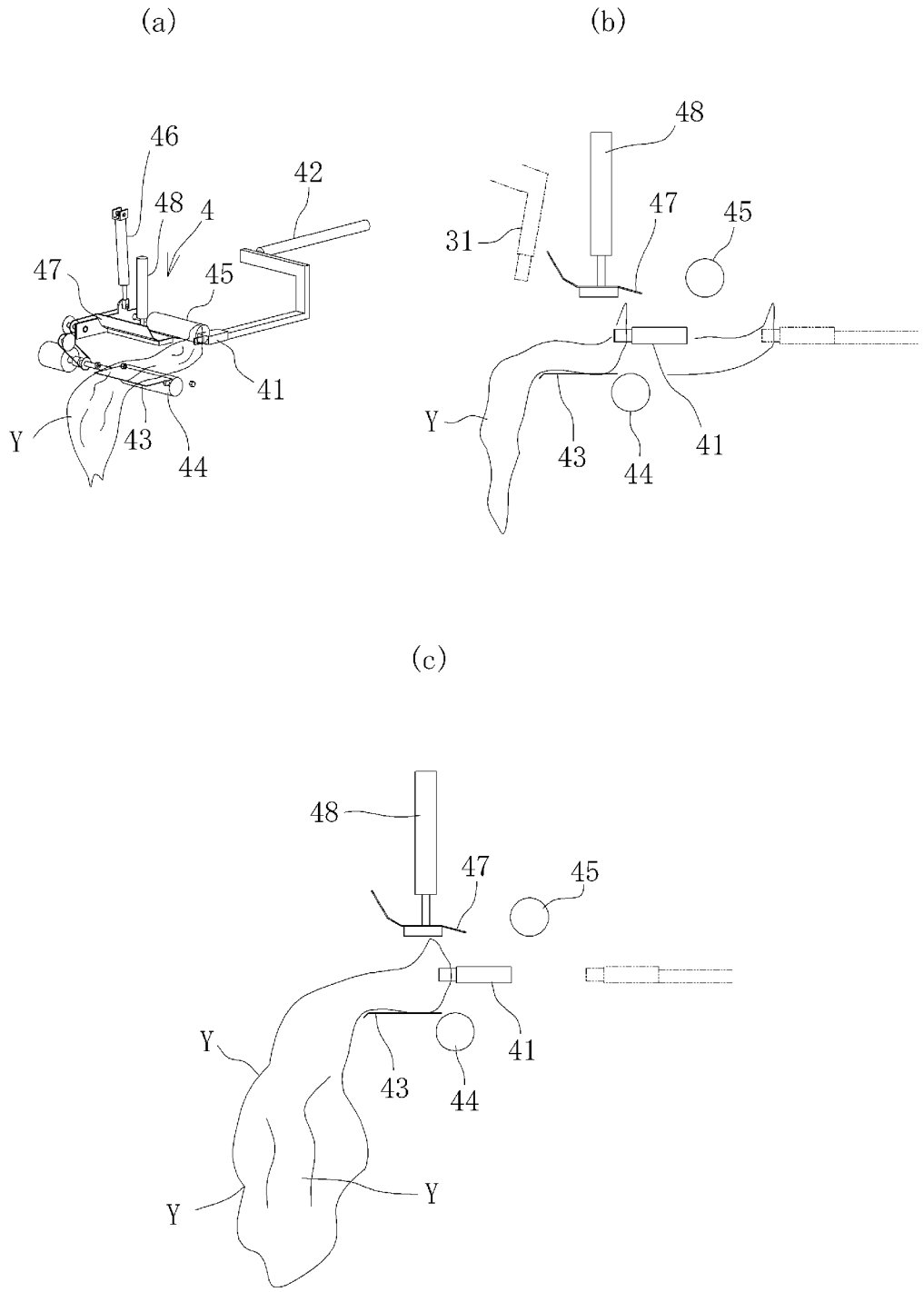
FIGS. 36 (*a*) and (*b*) are an enlarged perspective view and an enlarged side view showing an example of successful handling by a chuck of the corner end locating device as a cloth handling device of the automatic cloth spreading machine of FIG. 1, and FIG. 36 (*c*) is an enlarged side view showing an example of failed handling by the chuck of the corner end locating device.
Figure 37:
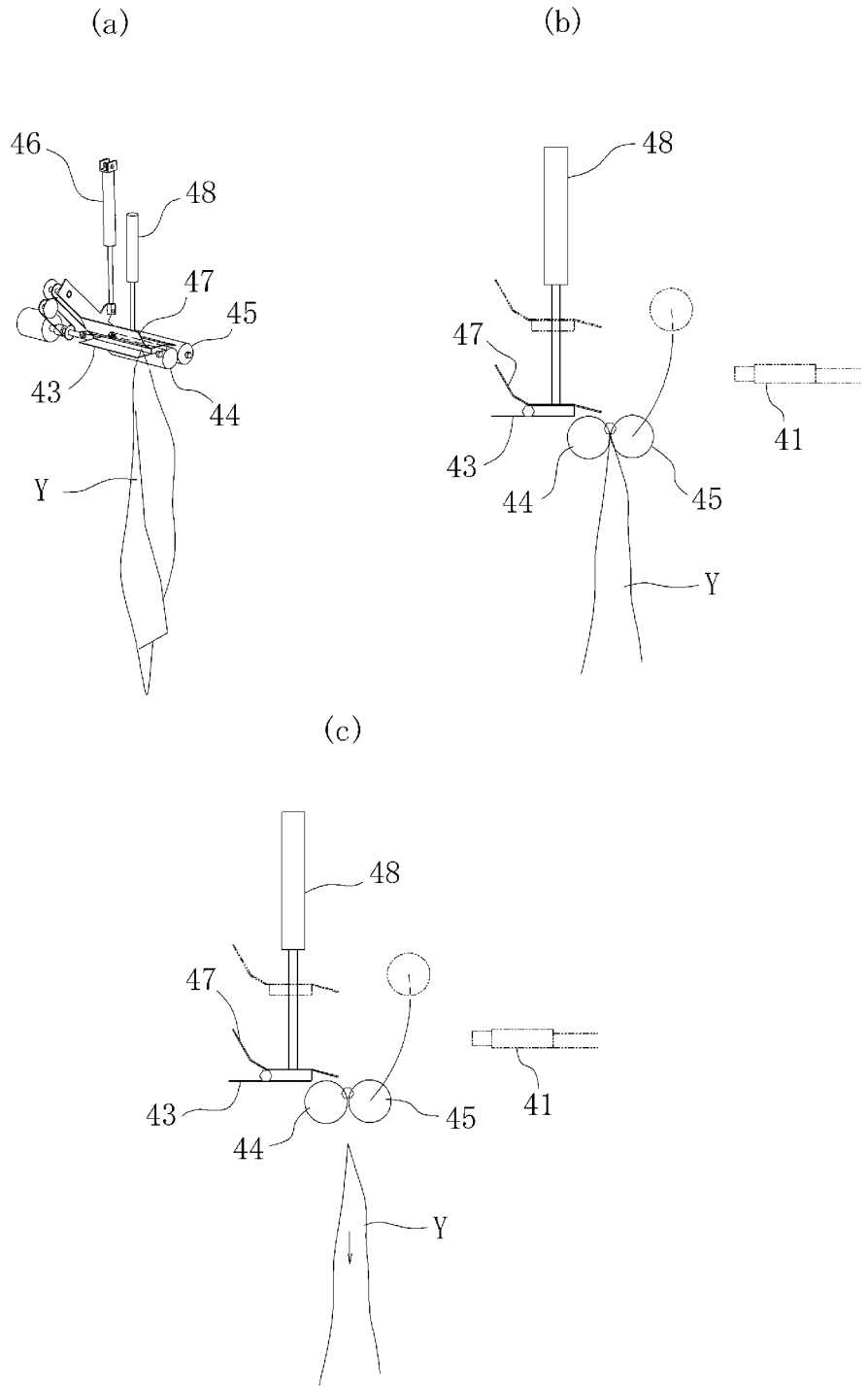
FIGS. 37 (*a*) and (*b*) are an enlarged perspective view and an enlarged side view showing an example of successful handling by rollers of the corner end locating device as a cloth handling device of the automatic cloth spreading machine of FIG. 1, and FIG. 37 (*c*) is an enlarged side view showing an example of failed handling by the rollers of the corner end locating device.

In the automatic cloth spreading machine of this reference embodiment, failure in handling cloth Y can occur, for example, in each of the lifting device 2, the corner end locating device 4, and the corner end receiving device 5 of the separating means as shown in FIG. 35 to FIG. 37.

Specifically, in the lifting device 2, the chuck 21 is supposed to hold an arbitrary portion of one or more pieces of cloth Y from a mass of cloth X on the supply conveyor 1 by the clamps and lift these pieces of cloth Y to a predetermined level as shown in FIG. 4 and FIG. 35 (*a*). However, the chuck 21 may fail to lift the cloth Y as shown in FIG. 35 (*b*). Examples of causes include that, as shown in FIG. 35 (*c*), a piece of cloth Y that the chuck 21 tries to lift is entangled with another piece of cloth inside the mass of cloth X and thus too large a load is applied to the clamps of the chuck 21 that are shaped, as mentioned above, so as not to damage cloth even when pulling the cloth, and that, as shown in FIG. 35 (*d*), a location at which the chuck 21 thrusts the clamps is a relatively flat portion of the mass of cloth X and therefore the clamps cannot hold the cloth Y.

In the corner end locating device 4, the chuck 41 is supposed to hold the cloth Y having been held and hung by the chuck 31 of the temporary holding device 3 and pull the cloth Y over the platform 43 and into the gap between the corner end locating rollers 44, 45 as shown in FIG. 6 and FIGS. 36 (*a*) and (*b*). However, the chuck 41 may fail to pull in the cloth Y as shown in FIG. 36 (*c*). Examples of causes include that a plurality of (e.g., three to five) pieces of cloth Y are entangled with one another in front of the platform 43 and thus too large a load is applied to the clamps of the chuck 41, and that the chuck 41 holds the cloth Y at a position too near an edge.

Figure 9:
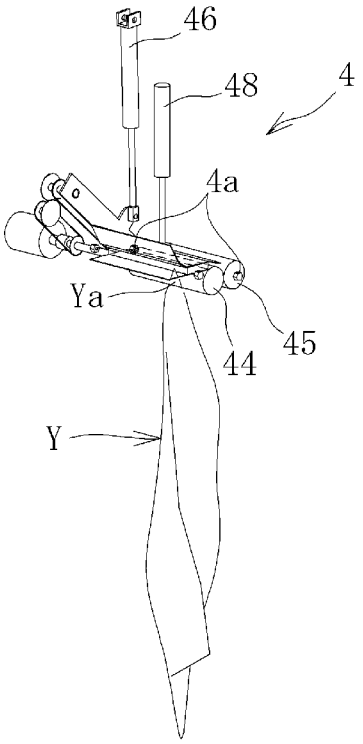
FIG. 9 is an enlarged perspective view of the corner end locating device of the automatic cloth spreading machine of FIG. 1.

Further, in the corner end locating device 4, to have the cloth Y in a single state and help the long-side edge Yc of the cloth Y appear in the horizontal pulling device 6 in a subsequent step, the corner end locating rollers 44, 45 are supposed to locate a portion of the cloth Y as close to a corner end as possible and hold the cloth Y as shown in FIG. 9 and FIGS. 37 (*a*) and (*b*). However, the corner end locating rollers 44, 45 may fail to hold the cloth Y as shown in FIG. 37 (*c*). Examples of causes include that the corner end of the cloth Y passes through the gap between the corner end locating rollers 44, 45, and that the cloth Y slips through the gap between the corner end locating rollers 44, 45.

Figure 38:
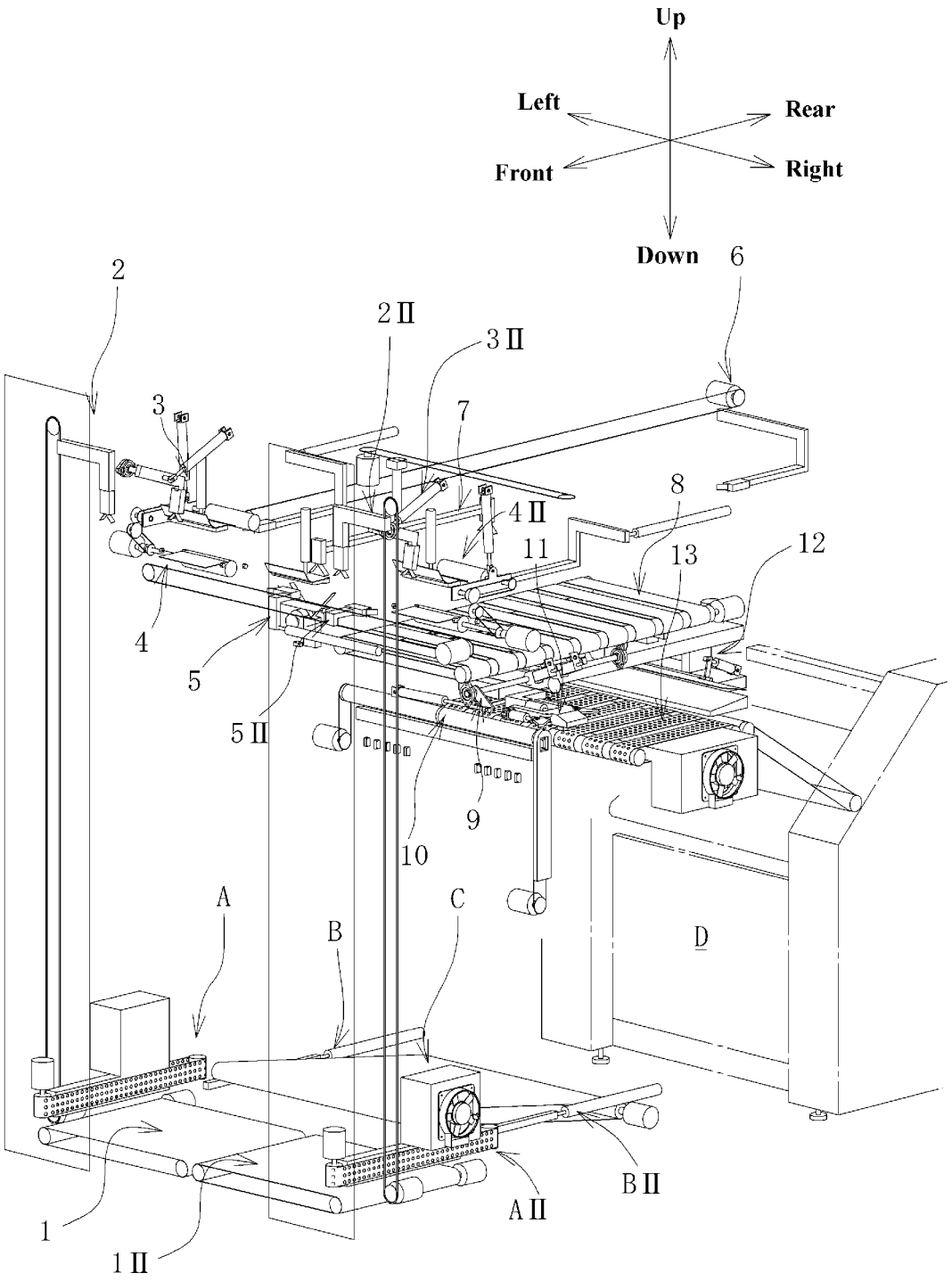
FIG. 38 is a schematic overall view of an automatic cloth spreading machine in one embodiment of the present invention that is improved from the automatic cloth spreading machine of FIG. 1.
Figure 39:
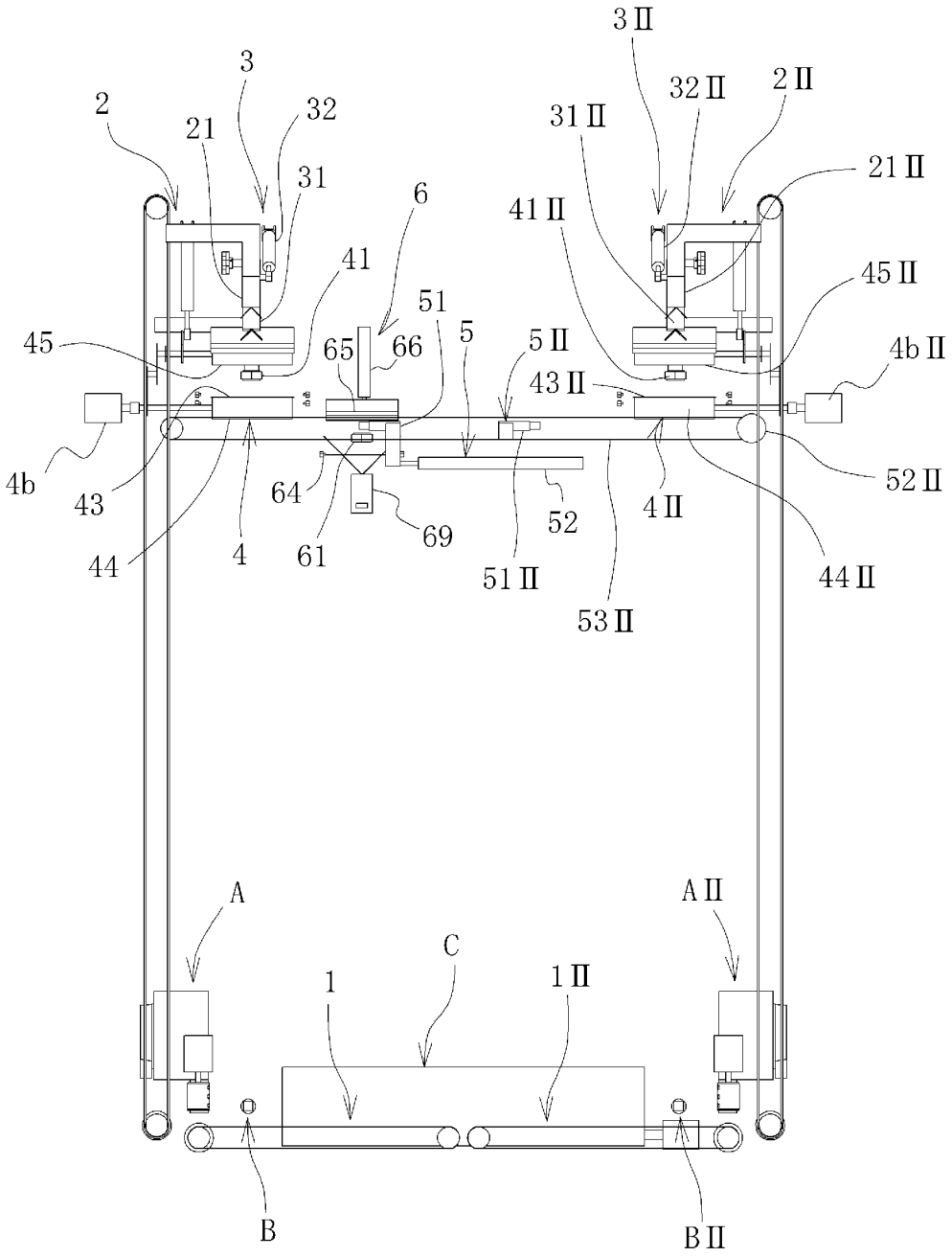
FIG. 39 is a front view showing two units each of supply conveyors, lifting devices, temporary holding devices, corner end locating devices, and corner end receiving devices included in the automatic cloth spreading machine of FIG. 38.

Thus, it is difficult to completely prevent failure in handling in the individual handling devices of the separating means. Therefore, as shown in the perspective view of FIG. 38 and the front view of FIG. 39, the automatic cloth spreading machine in one embodiment of the present invention includes two units each of supply conveyors 1, lifting devices 2, temporary holding devices 3, corner end locating devices 4, and corner end receiving devices 5 constituting the separating means in the automatic cloth spreading machine of the above-described reference embodiment, and the second unit of each set of devices is denoted by reference sign with II added thereto. The first and second units of these devices have the same function and the two units of cloth handling devices operate simultaneously.

Figure 40:
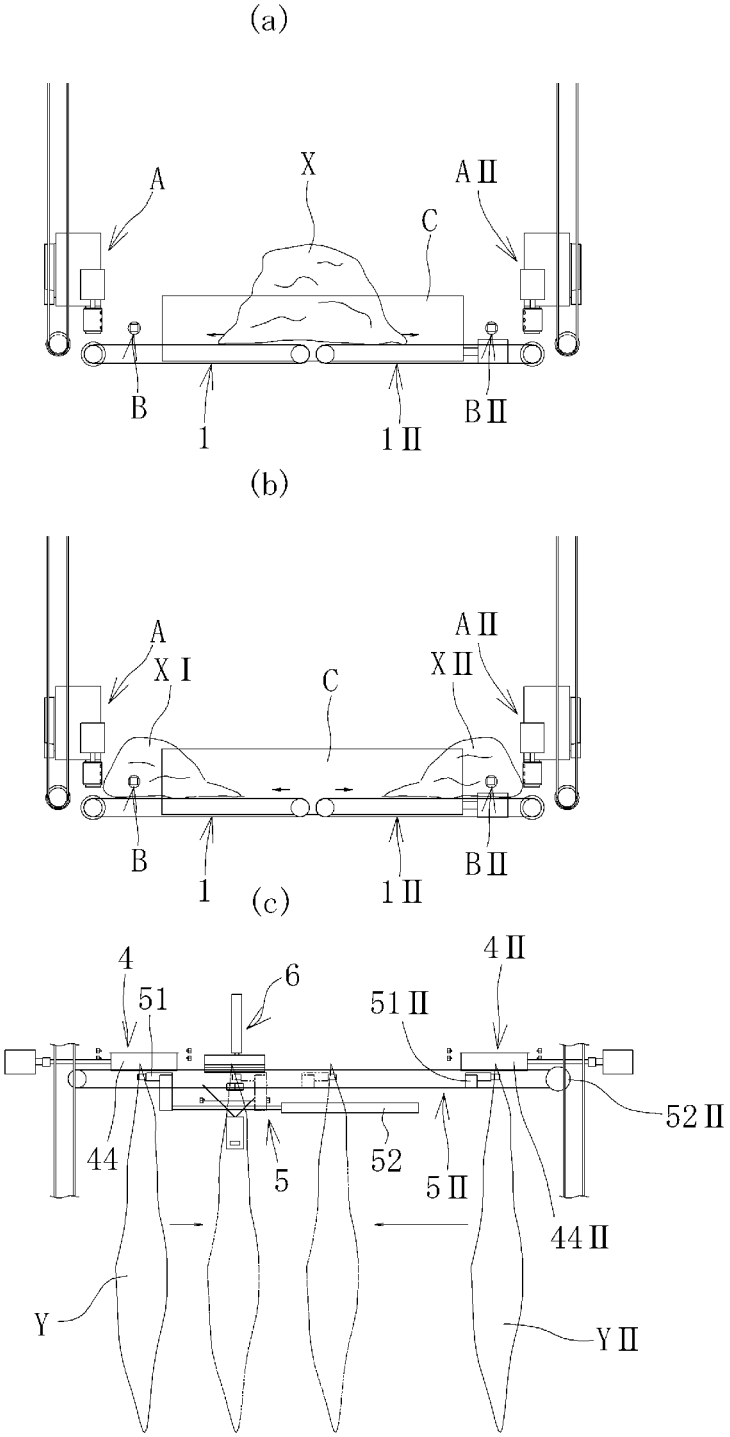
FIGS. 40 (*a*) and (*b*) are views illustrating actions of the supply conveyors and the lifting devices of the automatic cloth spreading machine of FIG. 38, and FIG. 40 (*c*) is a view illustrating actions of the corner end receiving devices of the automatic cloth spreading machine of FIG. 38.

Specifically, the automatic cloth spreading machine in this embodiment includes a supply conveyor 1 and a supply conveyor 1II that face the opposite directions at a central part of a lower end of the automatic cloth spreading machine, and a lifting device 2 and a lifting device 2II that face each other at left and right end parts of the automatic cloth spreading machine. As shown in FIG. 40 (*a*), when a mass of cloth X consisting of a plurality of (e.g., about 10 to 50) dried pieces of cloth Y is thrown to the center between the supply conveyor 1 and the supply conveyor 1II, the supply conveyor 1 performs an action of transferring the cloth Y to the lifting device 2, while the supply conveyor 1II performs an action of transferring the cloth Y to the lifting device 2II, so that the mass of cloth X is divided into two roughly equal parts and these parts are respectively transferred to directly under the lifting devices 2, 2II.

When the mass of cloth X cannot be equally divided, first, the mass of cloth X may be transferred by the supply conveyors 1, 1II to directly under one of the lifting devices 2, 2II, and when some of the cloth Y are lifted by that lifting device and the volume of the cloth Y in the mass of cloth X has decreased to some extent, this mass of cloth X may be transferred by the supply conveyors 1, 1II to directly under the other one of the lifting devices 2, 2II and the cloth Y may be lifted by that lifting device.

The automatic cloth spreading machine in this embodiment further includes a temporary holding device 3 and a temporary holding device 3II that face each other near lifting positions of the lifting devices 2, 2II, respectively. A chuck 31 of the temporary holding device 3 receives a portion near an upper end portion of the cloth Y that has been hung and held by a chuck 21 of the lifting device 2 at its uppermost position, and hangs and holds the cloth Y at a backward position. Similarly, a chuck 31II of the temporary holding device 3II receives a portion near an upper end portion of the cloth Y that has been hung and held by a chuck 21II of the lifting device 2II at its uppermost position, and hangs and holds the cloth Y at a backward position.

The automatic cloth spreading machine in this embodiment further includes a corner end locating device 4 and a corner end locating device 4II that face each other near rear sides of the temporary holding device 3 and the temporary holding device 3II, respectively. A chuck 41 of the corner end locating device 4 holds a portion near the upper end portion of the cloth Y that has been held and hung by the chuck 31 of the temporary holding device 3, and pulls the cloth Y over a platform 43 and into the gap between corner end locating rollers 44, 45. The corner end locating rollers 44, 45 advance the cloth Y downward until a corner end of the cloth Y is held therebetween, and then the corner end locating rollers 44, 45 are stopped so as to hang the cloth Y. Similarly, a chuck 41II of the corner end locating device 4II holds a portion near the upper end portion of the cloth Y that has been held and hung by the chuck 31II of the temporary holding device 3II, and pulls the cloth Y over a platform 43II and into the gap between corner end locating rollers 44II, 45II. The corner end locating rollers 44II, 45II advance the cloth Y downward until a corner end of the cloth Y is held therebetween, and then the corner end locating rollers 44II, 45II are stopped so as to hang the cloth Y.

The automatic cloth spreading machine in this embodiment further includes a corner end receiving device 5 and a corner end receiving device 5II at an upper central part of the automatic cloth spreading machine. As shown in FIG. 40 (*c*), a chuck 51 of the corner end receiving device 5 is moved forward and backward by a cylinder 52 so as to hold a portion near the upper end portion of the cloth Y that has been held at the corner end and hung by the corner end locating device 4, and then the chuck 51 is moved to a front side of the horizontal pulling device 6. Meanwhile, a chuck 51II of the corner end receiving device 5II is moved forward and backward by a belt 53II driven by a motor 52II so as to hold a portion near the upper end portion of the cloth YII that has been held at the corner end and hung by the corner end locating device 4II, and then the chuck 51II is moved to the front side of the horizontal pulling device 6 under control of the above-mentioned controller, at such a timing as not to interfere with the chuck 51. A chuck 61 of the horizontal pulling device 6 receives the cloth Y, YII from the chucks 51, 51II and horizontally pulls the cloth Y, YII over a platform 64.

Thus, in the automatic cloth spreading machine in this embodiment, even when one of the two units of devices that perform the same process as the supply conveyors 1, the lifting devices 2, the temporary holding devices 3, the corner end locating devices 4, or the corner end receiving devices 5 constituting the separating means fails in handling, the other device simultaneously performs the same process so as not to disrupt the process. Therefore, a decrease in the number of pieces of cloth Y processed in the horizontal pulling device 6 and subsequent steps can be prevented.

Moreover, in the automatic cloth spreading machine in this embodiment, the cloth handling devices constituting the separating means include two units each of supply conveyors 1, lifting devices 2, temporary holding devices 3, corner end locating devices 4, and corner end receiving devices 5 to perform the same process, and each of the processes of a supply step, a lifting step, a temporary holding step, a corner end locating step, and a corner end receiving step for separating pieces of cloth Y one by one from a mass of cloth X is simultaneously performed by the two units of cloth handling devices. Even when one of the two units of cloth handling devices that perform the same process fails in handling, the other cloth handling device simultaneously performs the same process so as not to disrupt the process. Therefore, a decrease in the number of pieces of cloth Y processed in the horizontal pulling device 6 and subsequent steps can be prevented by a minimum necessary, inexpensive configuration.

Furthermore, in the automatic cloth spreading machine in this embodiment, the separating means includes ten units of cloth handling devices, namely, the supply conveyors 1, 1II, the lifting devices 2, 2II, the temporary holding devices 3, 3II, the corner end locating devices 4, 4II, and the corner end receiving devices 5, 5II, that perform the process of separating pieces of cloth Y one by one from a mass of cloth X sequentially in the five steps of the supply step, the lifting step, the temporary holding step, the corner end locating step, and the corner end receiving step, and each set of these cloth handling devices is two units of cloth handling devices that perform the same process. Even when one of the two units of cloth handling devices that perform the same process in one of these five steps fails in handling, the other cloth handling device simultaneously performs the same process so as not to disrupt the process. Therefore, a decrease in the number of pieces of cloth Y processed in the horizontal pulling device 6 and subsequent steps can be reliably prevented.

While the present invention has been described above based on the shown examples, the present invention is not limited to the above-described examples and changes can be made thereto as necessary within the scope of the description of the claims. In the automatic cloth spreading machine of the present invention, for example, the temporary holding device 3 may be omitted from the separating means and cloth Y may be directly passed from the lifting device 2 to the corner end locating device 4. There may be three or more units of cloth handling devices that simultaneously perform the same process. Multiple units of cloth handling devices may be provided for a certain one or ones of the supply conveyor 1, the lifting device 2, the temporary holding device 3, the corner end locating device 4, and the corner end receiving device 5 constituting the separating means, for example, for those that are particularly prone to failure in handling, to simultaneously perform the same process.

INDUSTRIAL APPLICABILITY

As has been described above, in the automatic cloth spreading machine of the present invention, even when one of multiple units of cloth handling devices that perform the same process as the separating means fails in handling, the other cloth handling device simultaneously performs the same process so as not to disrupt the process. Therefore, a decrease in the number of pieces processed in a step subsequent to the separating means can be prevented.

REFERENCE SIGNS LIST

1, 1II Supply conveyor
1*a* Motor
1*b* Wall
2, 2II Lifting device
21, 21II Chuck
22 Motor
23 Driving belt
3, 3II Temporary holding device
31, 31II Chuck
32, 32II Extending-contracting cylinder
4, 4II Corner end locating device
41, 41II Chuck
42, 46, 48 Extending-contracting cylinder
43, 43II Platform
44, 44II, 45, 45II Corner end locating roller
47 Pressing plate
49, 4*a* Sensor
4*b*, 4*b*II Motor
5, 5II Corner end receiving device
51, 51II Chuck
52 Extending-contracting cylinder
52II Motor
53 Sensor
53II Belt
6 Horizontal pulling device
61, 69 Chuck
62 Motor
63 Driving belt
64 Platform
65 Upper pressing plate
66 Cylinder
67, 68 Sensor
7 Two-position holding device
70 Coupling rod
71 Intermediate portion holding chuck
72 Corner end holding chuck
73 Upward-downward moving cylinder
74 Motor
75 Driving belt
8 Edge locating conveyor
81 Motor
82 Blowing device
83 Sensor
9 Vertically inverting device
91 Turning cylinder
92, 93 Chuck
94, 95 Sensor
96 Reversing shaft
10 Roller
101 Sensor
102 First roller part
103 Second roller part
104, 106 Motor
105, 107 Driving belt
108, 109 Sensor group
10*a* Blowing member
11 Hanging device
110 Forward-backward moving platform
111, 112 Chuck
113, 114 Chuck sensor
115 Motor
116 Driving belt
12 Forward-backward moving device
121 Motor
122 Driving belt
123*a* Holding platform
123*b* Holding plate
124 Cylinder
13 Transfer conveyor
131 Suction fan
132 Motor
133 Belt
A, AII Suction conveyor
B, BII Push-out device C Return conveyor
D Cloth folding machine
X Mass of cloth
Y, YII Cloth
Ya Corner end
Yb Corner end (terminal end portion)
Yc Side edge (long side)
Yd Side edge (other long side)
Ye Side edge (short side)

The invention claimed is:

1. An automatic cloth spreading machine comprising a separating device for separating a mass of cloth, the separating device having a first conveyor and a second conveyor in line but configured to convey away from one another, the mass of cloth being provided to the first conveyor and the second conveyor simultaneously, a first lifting device at an end of the first conveyor opposite the second conveyor, a first temporary holding device configured to hold a first piece of cloth after the first piece of cloth is lifted by the first lifting device, a first corner end locating device configured to receive the first piece of cloth from the first temporary holding device and locate a first corner of the first piece of cloth, a first corner end receiving device configured to receive the first corner, a second lifting device at an end of the second conveyor opposite the first conveyor, a second temporary holding device configured to hold a second piece of cloth after the second piece of cloth is lifted by the second lifting device, a second corner end locating device configured to receive the second piece of cloth from the second temporary holding device and locate a second corner of the second piece of cloth, and a second corner end receiving device configured to receive the second corner, and a pulling device configured to pull the first piece of cloth after receipt from the first corner end receiving device and pull the second piece of cloth after receipt from the second corner end receiving device, the automatic cloth spreading machine further comprising an edge locating device configured to locate an edge of each of the first piece of cloth and the second piece of cloth, both having been pulled, a spreading device configured to spread the first piece of cloth and the second piece of cloth, the edge of which having been located, and a discharging device configured to discharge the first piece of cloth and the second piece of cloth, both having been spread.

2. The automatic cloth spreading machine according to claim 1, further comprising a third conveyor configured to transport items to where the first conveyor and the second conveyor convey away from one another.

3. The automatic cloth spreading machine according to claim 2, wherein the third conveyor is positioned so that cloth that has fallen during processing by one of the pulling device, the edge locating device, and the spreading device lands on the third conveyor.

4. The automatic cloth spreading machine according to claim 2, wherein the first conveyor and the second conveyor are configured to separate the mass of cloth after receiving the mass of cloth from the third conveyor.

5. An automatic cloth spreading machine comprising a separating means for separating pieces of cloth one by one from a single mass of cloth, an edge locating means for locating an edge of each of the pieces of cloth having been separated one by one, a spreading means for spreading the piece of cloth, the edge of which has been located, and a discharging means for discharging the piece of cloth having been spread to a subsequent step, wherein the separating means includes two cloth handling devices that perform the same process but are oriented to separate the pieces of cloth from opposite sides of the single mass of cloth, and the two cloth handling devices simultaneously perform at least one of single- or multiple-step processes of separating pieces of cloth one by one from the mass of cloth.

* * * * *